US005450045A

United States Patent [19]

Miura et al.

[11] Patent Number: 5,450,045

[45] Date of Patent: Sep. 12, 1995

[54] MULTI-LAYER MICROWAVE CIRCULATOR

[75] Inventors: Taro Miura, Tokyo; Makoto Kobayashi, Chiba; Kazuaki Suzuki, Chiba; Tadao Fujii, Chiba, all of Japan

[73] Assignee: TDK Corporation, Tokyo, Japan

[21] Appl. No.: 219,917

[22] Filed: Mar. 30, 1994

[30] Foreign Application Priority Data

Mar. 31, 1993 [JP] Japan ..... 5-094950
Mar. 31, 1993 [JP] Japan ..... 5-094951

[51] Int. Cl.[6] ..... H01P 1/387

[52] U.S. Cl. ..... 333/1.1; 333/24.1; 427/130

[58] Field of Search ..... 333/1.1, 24.1, 24.2, 333/24.3

[56] References Cited

U.S. PATENT DOCUMENTS 3,873,944 3/1975 Vaguine et al. ..... 333/1.1
4,703,289 10/1987 Kwitkowski et al. ..... 333/1.1
5,006,182 4/1991 Gantzhorn, Jr. et al. ..... 156/89
5,120,377 6/1992 Morohashi et al. ..... 156/89
5,157,360 10/1992 McGann et al. ..... 333/24.2 X

FOREIGN PATENT DOCUMENTS 52-32713 8/1977 Japan .
5-37206 2/1993 Japan .
5-167314 7/1993 Japan .
5-183314 7/1993 Japan .
5-251262 9/1993 Japan .
5-315757 11/1993 Japan .
5-327221 12/1993 Japan .
6-6112 1/1994 Japan .
6-61708 3/1994 Japan .

OTHER PUBLICATIONS

Copending commonly assigned U.S. Patent Appln. Ser. No. 07/885,639, filed: May 19, 1992.

*Primary Examiner*—Paul Gensler
*Attorney, Agent, or Firm*—Nikaido, Marmelstein, Murray & Oram

[57] ABSTRACT

A circulator includes a circulator element (50) with inner conductors (41) having a predetermined pattern and an insulating ferromagnetic material body (40) closely surrounding the inner conductors. The insulating ferromagnetic material body is constituted by a fired single continuous body. The circulator also includes a plurality of terminal electrodes (76) formed on side surfaces of the circulator element and electrically connected to one end of the inner conductors, a plurality of circuit elements (51*a*, 51*b*, 51*c*) electrically connected to the terminal electrodes, and excitation permanent magnets (52, 53) for applying a dc magnetic field to the circulator element.

40 Claims, 25 Drawing Sheets

Hi ; DC MAGNETIC FIELD PERPENDICULAR TO Hrf

Hrf ; ROTATING RF MAGNETIC FIELD

MULTI-LAYER MICROWAVE CIRCULATOR

BACKGROUND OF THE INVENTION

1. Field of the Invention

The present invention relates to a circulator used in a microwave band radio device, for example in a mobile communication device such as a portable telephone.

2. Description of the Related Art

A conventional lumped element type circulator has an assembled circulator element with a circular plane shape and a basic structure as shown in an exploded oblique view of FIG. 1. In the figure, a reference numeral 10 denotes a circular substrate made of a non-magnetic material such as a glass-reinforced epoxy. Coil conductors (inner conductors) 11 and 12 are formed on top and bottom surfaces of the non-magnetic material substrate 10, respectively. These coil conductors 11 and 12 are electrically connected with each other by via holes 13 passing through the substrate 10. Circularly shaped members 14 and 15 made of a ferromagnetic material are attached to both surfaces of the non-magnetic material substrate 10 having the coil conductors 11 and 12 so that rotating RF (Radio Frequency) magnetic fluxes are induced in these ferromagnetic members 14 and 15 due to an RF power applied to the coil conductors 11 and 12. As aforementioned, the conventional circulator element in the circulator has a circular plane shape and is constructed by assembling, namely piling and bonding, the ferromagnetic members 14 and 15 on both sides of the non-magnetic material substrate 10.

The circulator is then constructed, as shown in its exploded oblique view of FIG. 2, by stacking and fixing in sequence grounding conductor electrodes 16 and 17, excitation permanent magnets 18 and 19 and a metal housing separated into upper and lower parts 20 and 21 on both ferromagnetic members 14 and 15, respectively. The housing parts 20 and 21 form a magnetic path of the magnetic flux from and to the excitation permanent magnets 18 and 19.

If an RF power is applied to the coil conductors 11 and 12 through input/output terminals not shown, RF magnetic flux rotating around the coil conductors 11 and 12 will be produced in the ferromagnetic members 14 and 15. Under this state, if a dc magnetic field perpendicular to the RF magnetic flux is applied from the permanent magnets 18 and 19, the ferromagnetic members 14 and 15 present different permeability $\mu_+$ and $\mu_-$ depending upon the rotating sense of the RF magnetic flux, as shown in FIG. 3. A circulator utilizes this difference of the permeability depending upon the rotating sense. Namely, a propagation velocity of the RF signal in the circulator element will differ in accordance with the rotating sense and thus the signals transmitted in opposite directions will be canceled by each other resulting in preventing the propagation of the signal to a particular port. A non-propagating port is determined in accordance with its angle against a driving port due to the permeability $\mu_+$ and $\mu_-$ of the ferromagnetic member. For example, if ports A, B and C are arranged in this order along a certain rotating sense, the port B will be determined as the non-propagating port against the driving port A and the port C will be determined as the non-propagating port against the driving port B.

The circulators have been broadly utilized as effective elements for preventing interference between amplifiers in a mobile communication device such as a portable telephone and also for protecting a power amplifier in the mobile communication device from a reflected power. With the spread of and downsizing of recent radio transmission devices, the circulators themselves are requested to be manufactured in lower cost and in smaller size and to operate with lower loss and in a broader frequency band. In order to satisfy these requirements, it will be necessary to make a circulator having a large difference between the permeability $\mu_+$ and $\mu_-$ and having a driving circuit with small loss.

However, according to the conventional circulator shown in FIG. 1, since the driving lines 11 and 12 are formed on the non-magnetic material substrate 10 and these lines and substrate are put between the two separated ferromagnetic members 14 and 15, the magnetic path of the circulator is blocked by the non-magnetic material substrate 10. Thus, a demagnetizing field will be produced at boundary faces between the non-magnetic material substrate 10 and the ferromagnetic members 14 and 15 causing the permeability to lower. As a result, the conventional circulator cannot sufficiently satisfy the aforementioned recent requirements.

In order to obtain a compact-sized circulator by reducing the demagnetizing field produced at the boundary faces of the substrate 10 against the ferromagnetic members 14 and 15, the inventors of this application made this substrate 10 by a sheet compounding a ferromagnetic material on an experimental basis. Although, this structure can somewhat reduce the demagnetizing field at the boundary faces, it is far from satisfying the aforementioned requests.

Furthermore, since the circulator element according to the conventional circulator is made in a circular plane shape, if discrete circuit elements, such as resonating capacitors or terminations, are additionally attached to terminals on its side surfaces, a total size of the circulator will become much larger.

Also, according to the conventional circulator, since the housing which constitutes a magnetic yoke is made by mechanically combining the separated upper and lower parts 20 and 21, a magnetic resistance of the magnetic path of excitation field will become extremely high and the assembly of the circulator will become very complicated.

There are some known structures of the circulator for increasing its inductance to lower its resonance frequency, such as coil lines are wound around a ferromagnetic material member or that ribbon looped electrodes are used. However, no circulator with the former structure winding the lines around the ferromagnetic material member has been put to practical use because it is difficult to mass produce. Furthermore, although a small-sized circulator having the latter structure using the ribbon looped electrodes has been developed, this circulator has the following problems.

(1) Since the coils are open, the circulator may be easily influenced by external electoro-magnetic fields. Thus, its housing and its magnets have to be disposed apart from each other such that practical downsizing of the circulator is very difficult.

(2) Since the ferromagnetic material member is prepared only at one side of the ribbon loop and thus the volume of the ferromagnetic material member will be insufficient, enough difference of the permeability $\mu_+$ and $\mu_-$ will not be practically obtained.

SUMMARY OF THE INVENTION

It is therefore an object of the present invention to provide a circulator which can be made ill a smaller size.

Another object of the present invention is to provide a circulator which can be manufactured in a lower cost.

Further object of the present invention is to provide a circulator capable of operating in a broader frequency range.

Still further object of the present invention is to provide a circulator capable of operating with lower loss.

According to the present invention, a circulator provided with a circulator element includes inner conductors having a predetermined pattern, which are made of a conductive material, and an insulating ferromagnetic material body closely surrounding the inner conductors. The insulating ferromagnetic material body is formed in a single continuous layer by firing a plurality of ferromagnetic material layers.

Since the insulating ferromagnetic material body for closely surrounding the inner conductors is sintered into a single continuous layer, there is no discontinuous portion in this ferromagnetic material body. Thus, the RF magnetic flux will close in the circulator element resulting that no demagnetizing field will be produced and thus the difference between the permeability $\mu_+$ and $\mu_-$ will become large. As a result, broader operating frequency range and lower loss can be obtained with a smaller size circulator.

It is preferred that the insulating ferromagnetic material body is constituted by a ferromagnetic material having a sintering completion temperature higher than a melting point of the conductive material of the inner conductors.

In this case, the inner conductors may be made of a metal which was once converted in a molten state.

The inner conductors may be constituted by a conductive material having a melting point higher than a sintering completion temperature of a ferromagnetic material of the inflating ferromagnetic material body.

The insulating ferromagnetic material body may be formed in a single continuous layer by firing art upper ferromagnetic material layer, at least one intermediate ferromagnetic material layer and a lower ferromagnetic material layer, and the circulator element may include coil conductors having a pattern wound at least one turn around the at least one intermediate ferromagnetic material sheet. The above-mentioned inner conductors constitutes a part of the coil conductors. According to this constitution, since the permeability $\mu_+$ and $\mu_-$ is large and also the number of turns of the coil is great (long length of the coil conductor), a necessary inductance can be obtained with a compact size.

Preferably, the coil conductors include the inner conductors formed on top surfaces of the intermediate ferromagnetic material layer and the lower ferromagnetic material layer, and jumper conductors for connecting ends of the inner conductors to each other.

Preferably, the circulator element includes grounding conductors formed on a top surface of the upper ferromagnetic material layer and a bottom surface of the lower ferromagnetic material layer, respectively.

As a whole, a circulator according to the present invention includes a circulator element with inner conductors having a predetermined pattern, made of a conductive material, and an insulating ferromagnetic material body closely surrounding the inner conductors, which insulating ferromagnetic material body is formed in a single continuous layer by firing a plurality of ferromagnetic material layers, a plurality of terminal electrodes formed on side surfaces of the circulator element and electrically connected to one end of the inner conductors, a plurality of circuit elements electrically connected to the terminal electrodes, and excitation permanent magnets for applying a dc magnetic field to the circulator element.

According to the present invention, a circulator also includes as a whole a circulator element with inner conductors having a predetermined pattern, made of a conductive material, an insulating ferromagnetic material body closely surrounding the inner conductors, which insulating ferromagnetic material body is formed in a single continuous layer by firing an upper ferromagnetic material layer, at least one intermediate ferromagnetic material layer and a lower ferromagnetic material layer, and coil conductors having a pattern wound at least one turn around the at least one intermediate ferromagnetic material sheet, the inner conductors constituting a part of the coil conductors, a plurality of terminal electrodes formed on the side surfaces of the circulator element and electrically connected to one end of the inner conductors, a plurality of circuit elements electrically connected to the terminal electrodes, and excitation permanent magnets for applying a dc magnetic field to the circulator element.

It is preferred that the circuit elements are a plurality of capacitors electrically connected to the respective terminal electrodes, for resonating with an applied frequency.

The circuit elements may be discrete circuit elements additionally attached and electrically connected to the respective terminal electrodes, or may be internal circuit elements integrally formed with the circulator element.

It is preferred that the circulator further includes a metal housing closely fixed to the excitation permanent magnets. This metal housing has a continuous magnetic path. Since the excitation magnetic path is continuous, a smaller magnetic resistance can be obtained causing its characteristics to extremely improve.

The circulator element may have a polygonal plane shape, preferably a hexagonal plane shape. Due to the polygonal plane shape of the circulator element, spaces for attaching discrete circuit elements such as resonating capacitors or termination resisters will remain on side surfaces of the circulator element. Therefore, if such discrete circuit elements are additionally attached to the circulator element, a total size of the circulator can be maintained small.

It is preferred that the inner conductors have a pattern with a plurality of strips extending, in a plane, to a plurality of symmetrical radiating directions, respectively.

In this case, the strips may include straight strips.

It is also preferred that the inner conductors have a pattern with at least one straight strip extending, in a plane, to a predetermined direction.

Further objects and advantages of the present invention will be apparent from the following description of the preferred embodiments of the invention as illustrated in the accompanying drawings.

Figure 1:
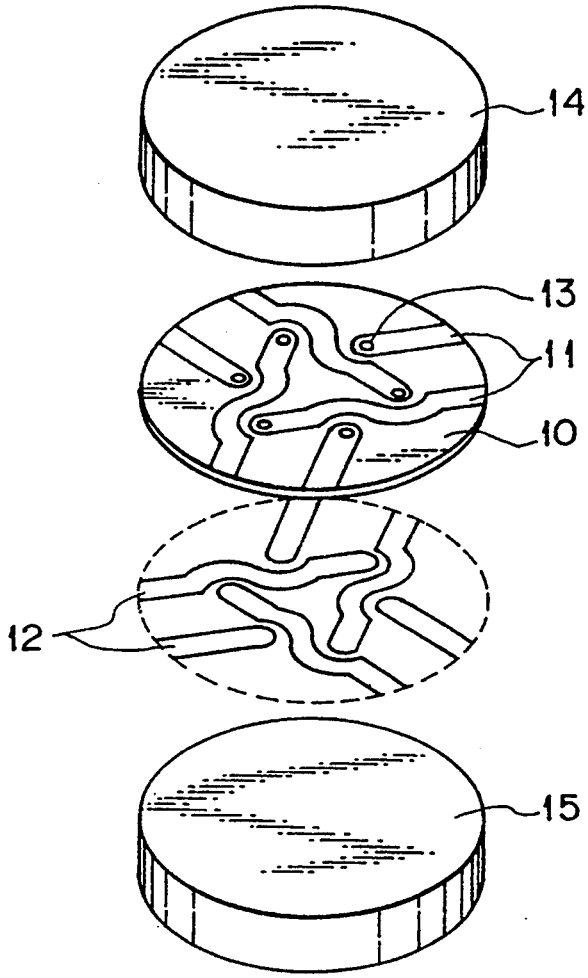
Fig. 1 PRIOR ART
FIG. 1 is an exploded oblique view showing the already described circulator element of the conventional lumped element type circulator.
Figure 2:
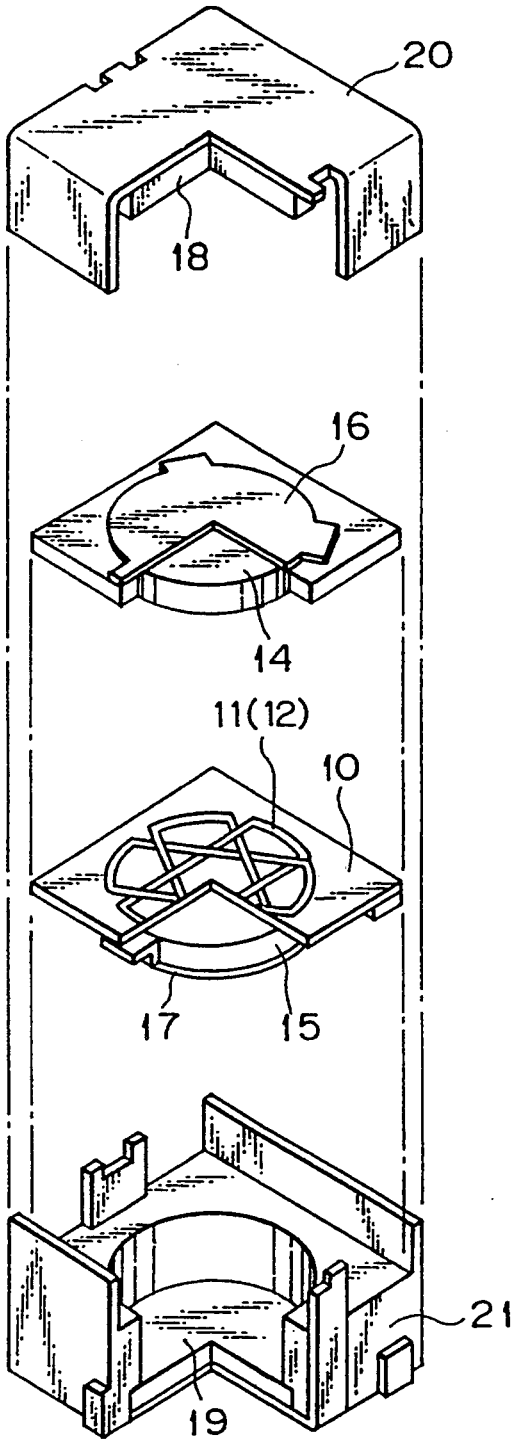
Fig. 2 PRIOR ART
FIG. 2 is an exploded oblique view illustrating the assemble of the already described conventional circulator.
Figure 3:
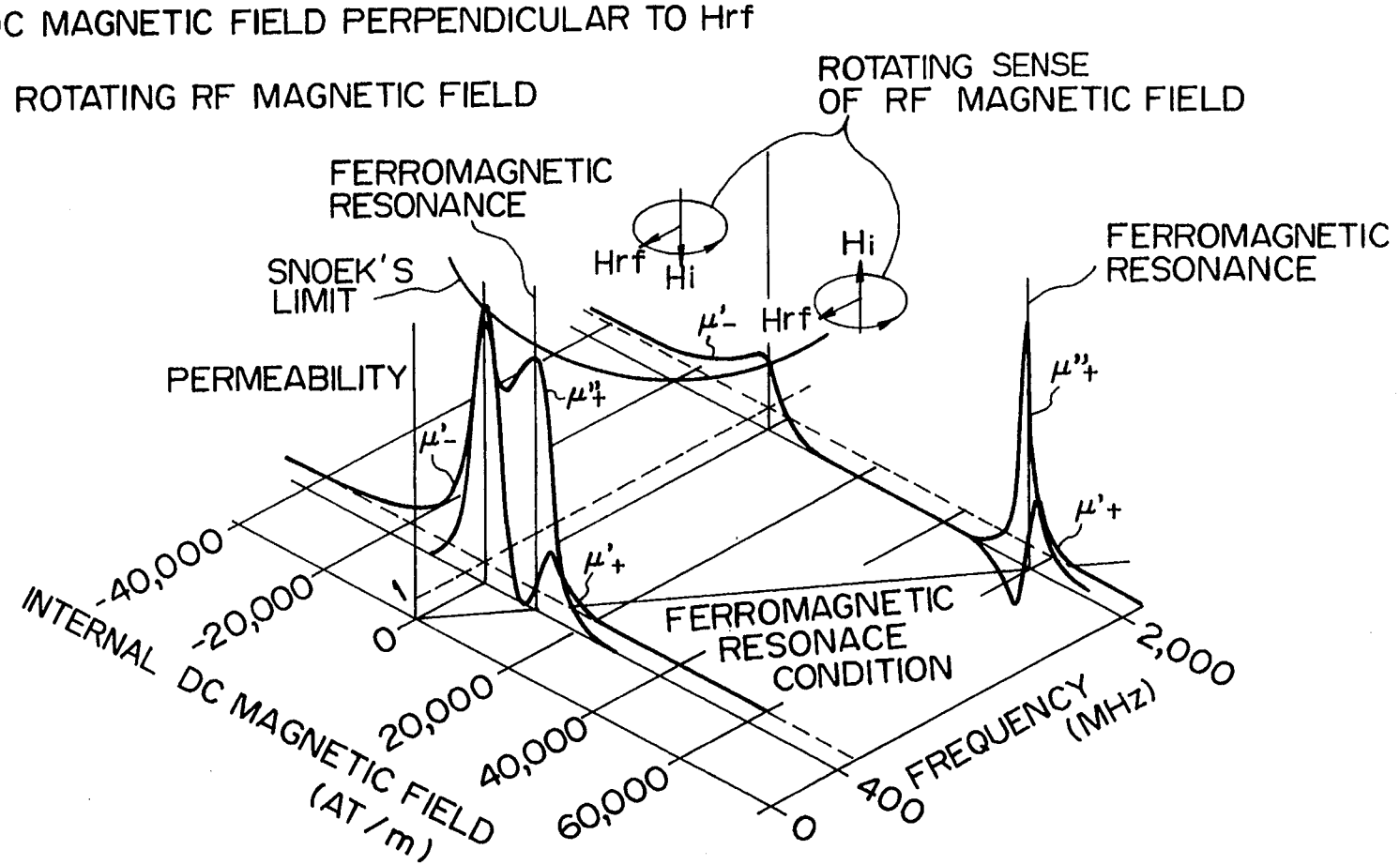
FIG. 3 shows a characteristics of gyromagnetic permeability of the ferromagnetic material.
Figure 4:
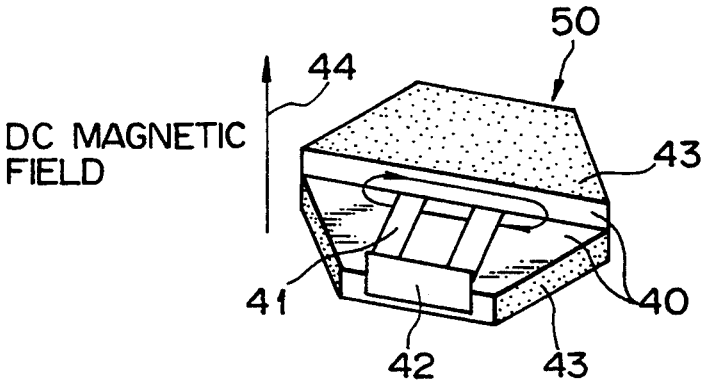
FIG. 4 is a partially cut away view in an oblique schematically showing a circulator element of a three-port circulator as an preferred embodiment according to the present invention.
Figure 8:
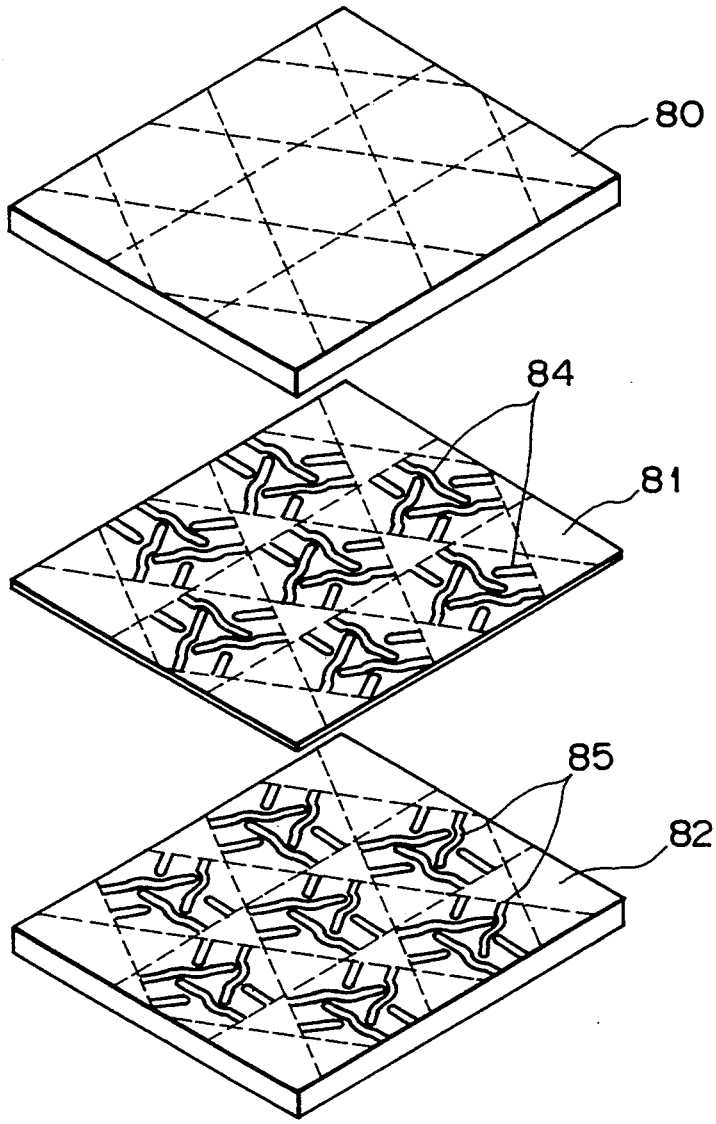
Figure 9:
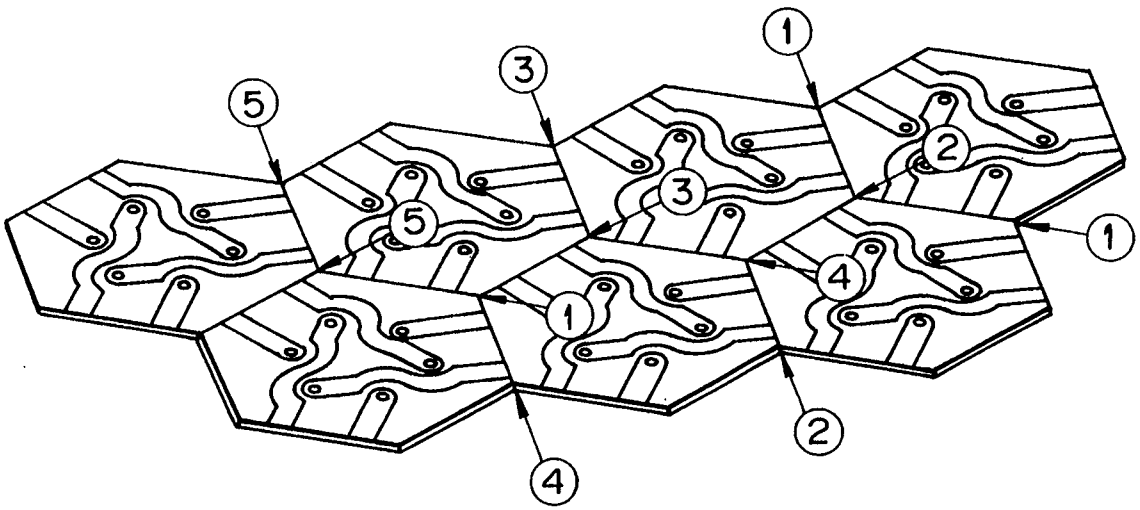
Figure 10A:
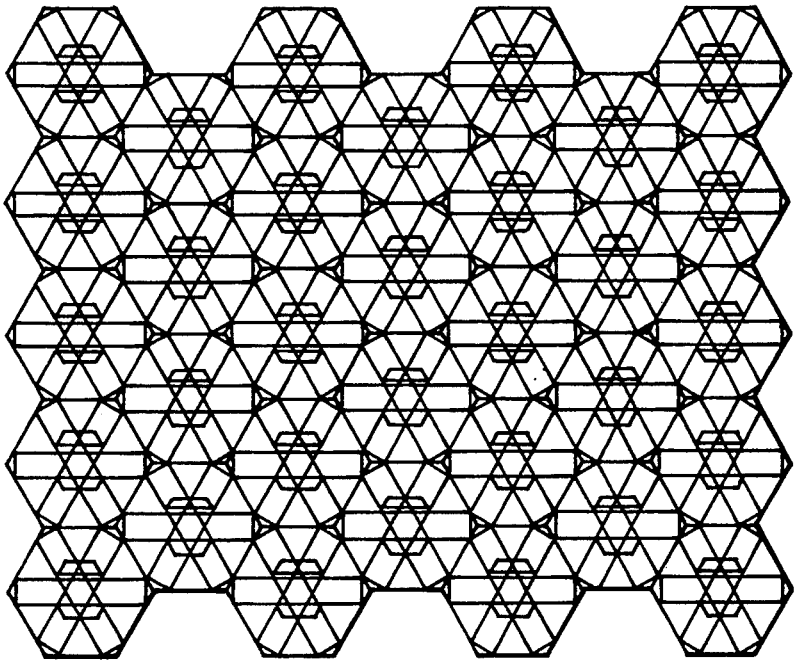
Figure 10B:
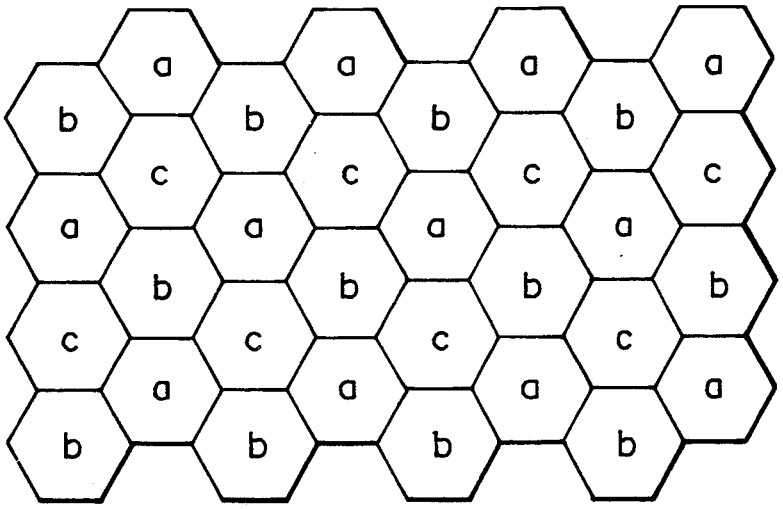
Figure 11A:
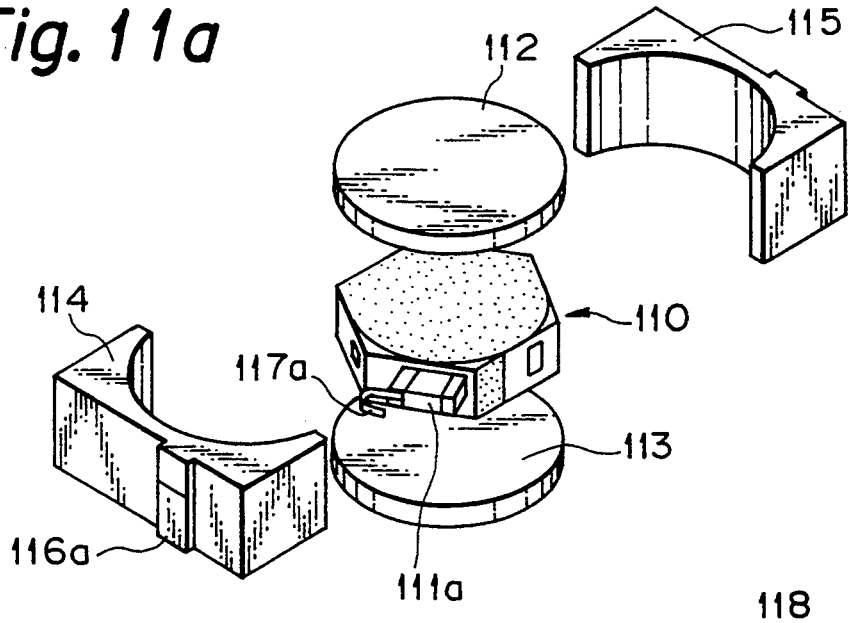
Figure 11B:
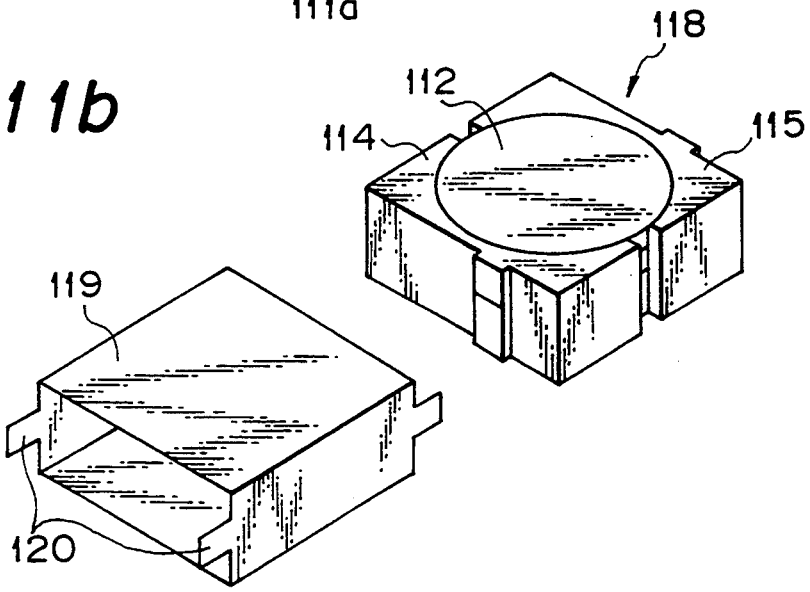
Figure 11C:
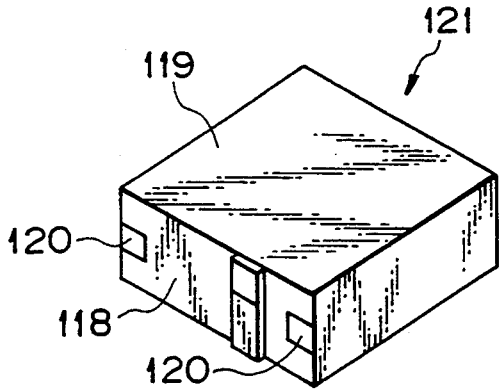
Figure 12:
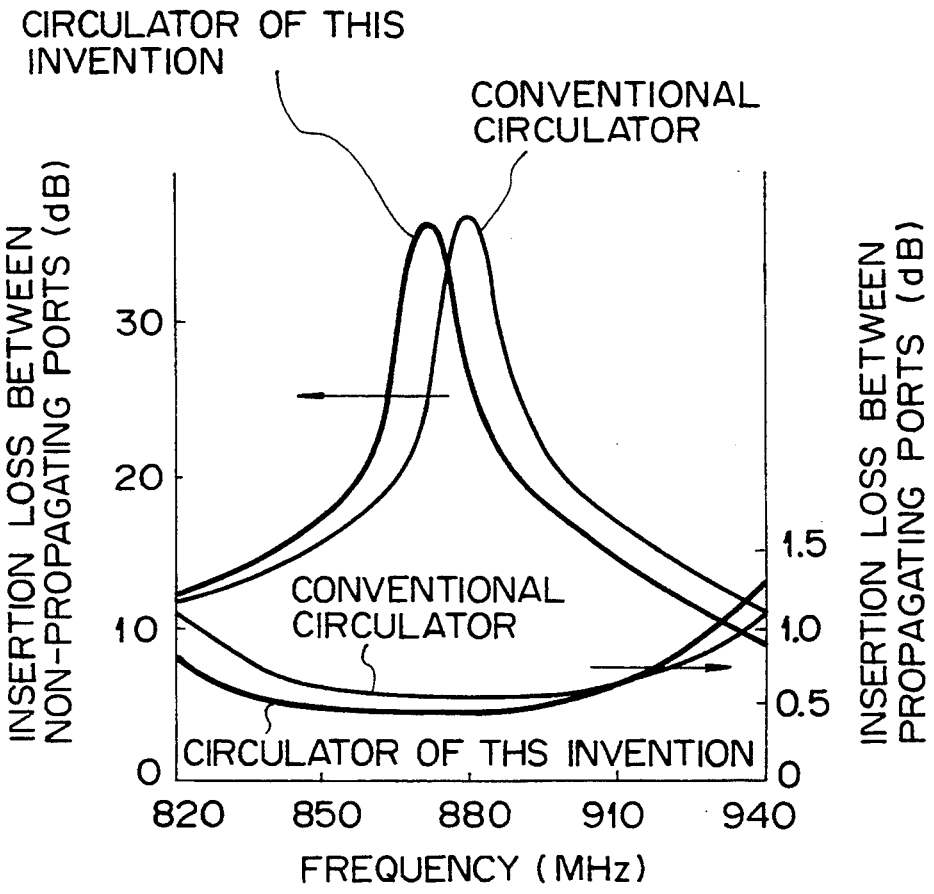
Figure 13:
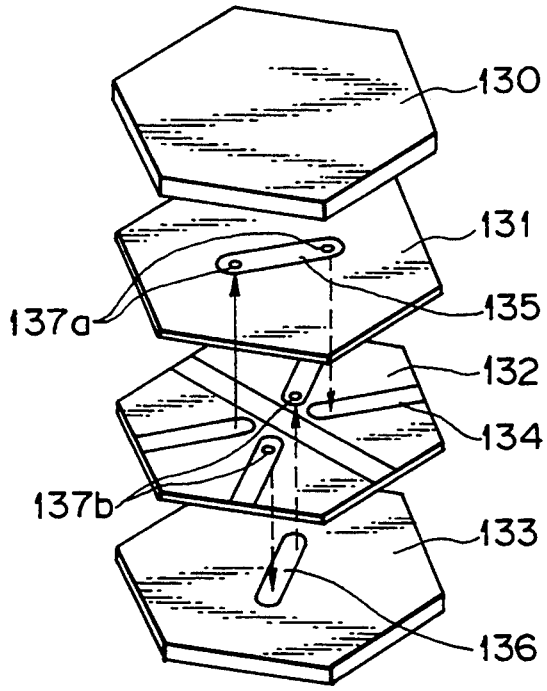
Figure 14:
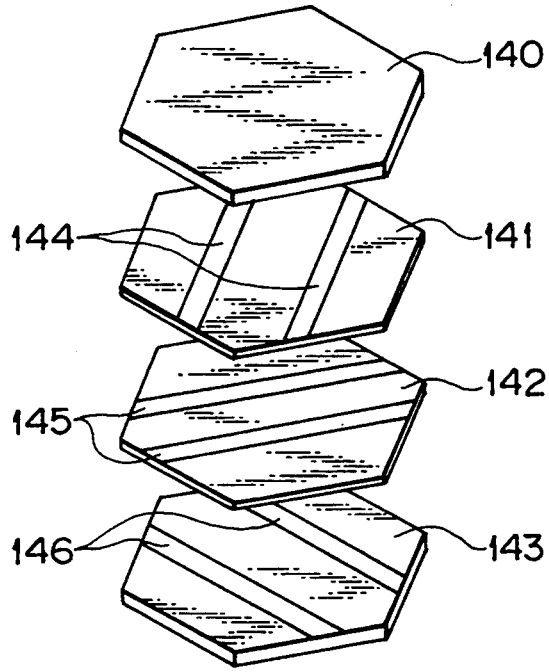
Figure 16:
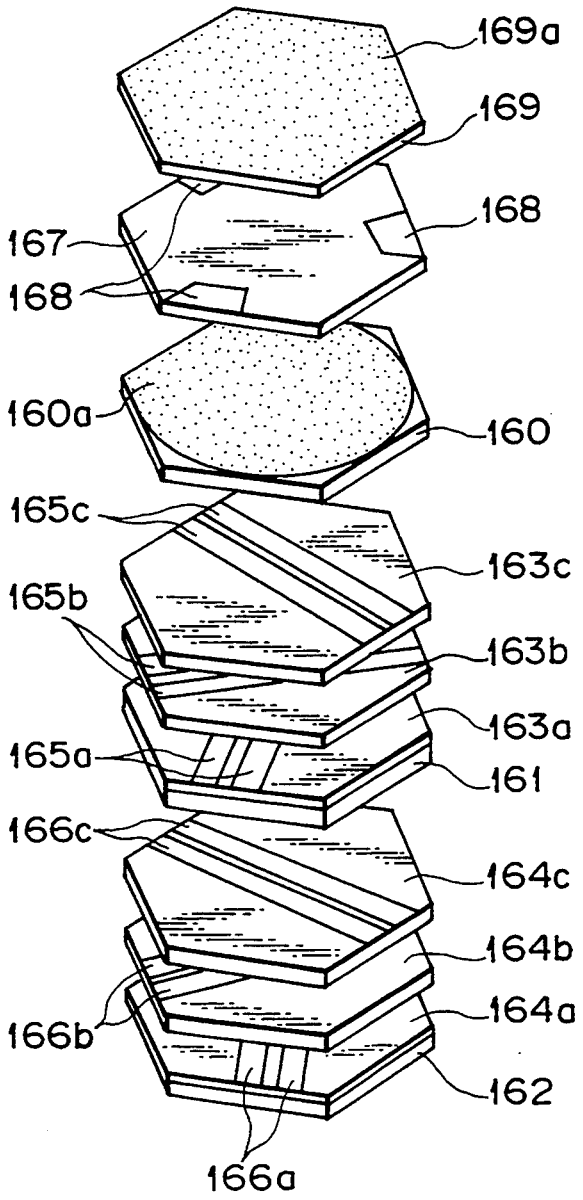
Figure 17:
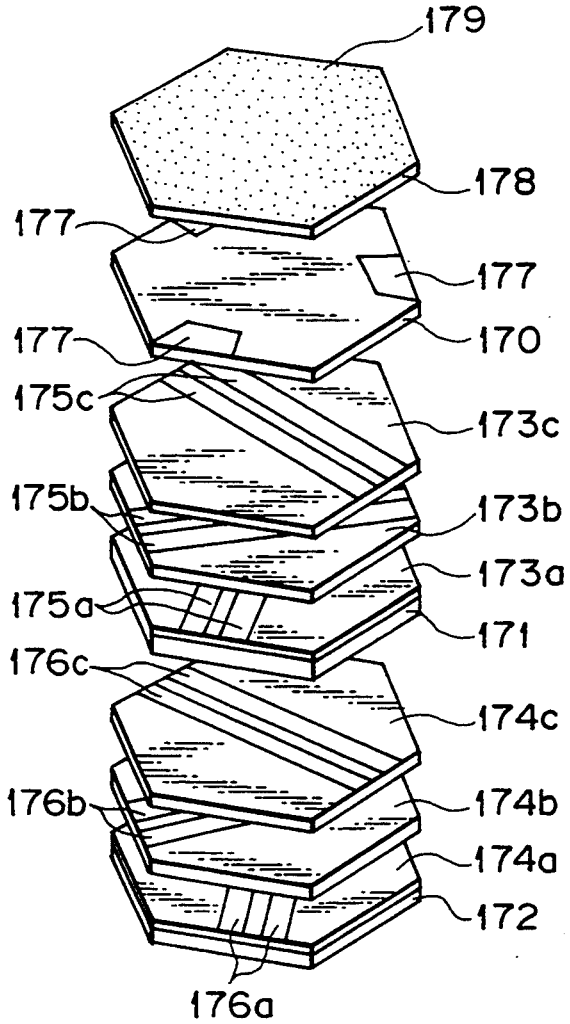
Figure 18:
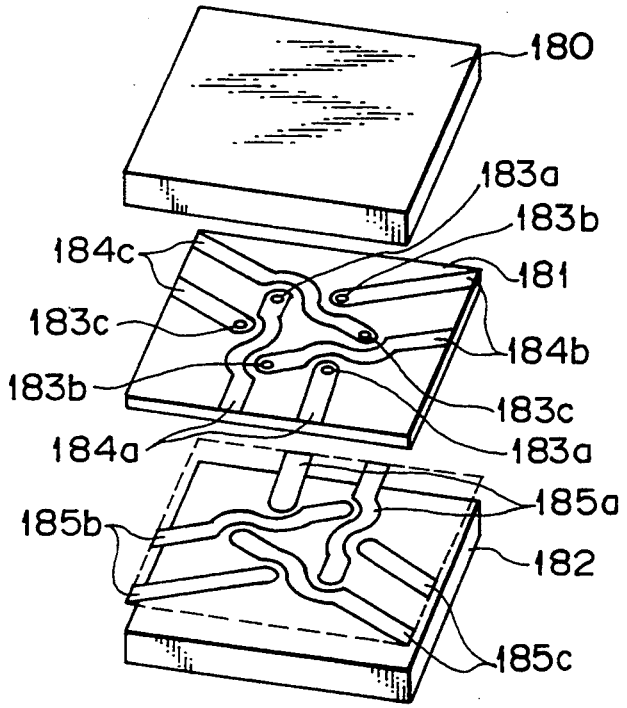
Figure 19:
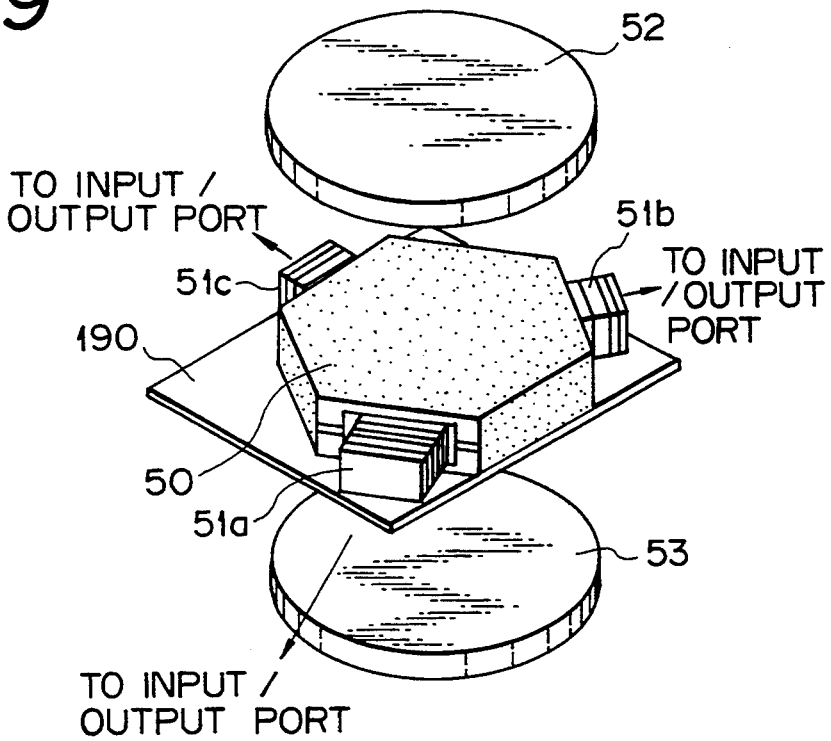
Figure 20:
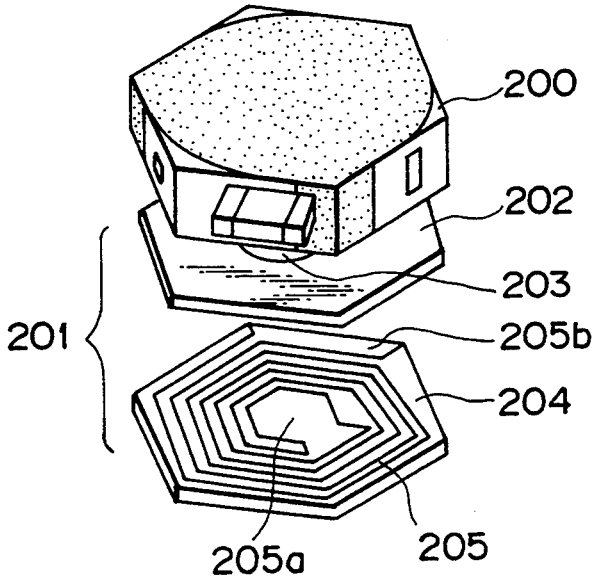
Figure 21:
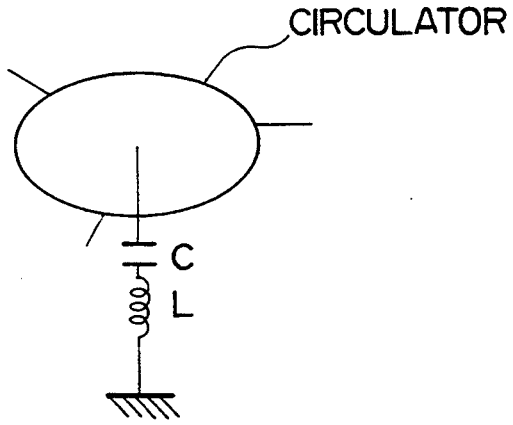
Figure 22:
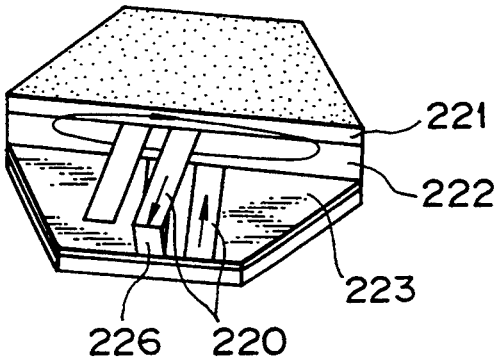
Figure 23:
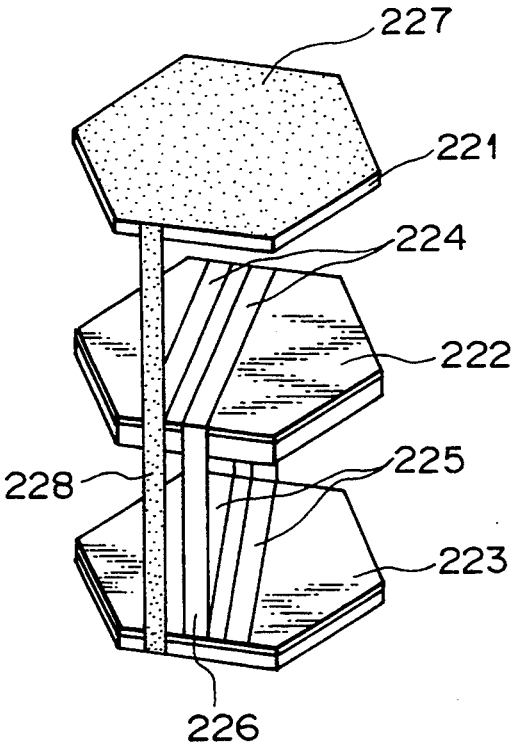
Figure 24:
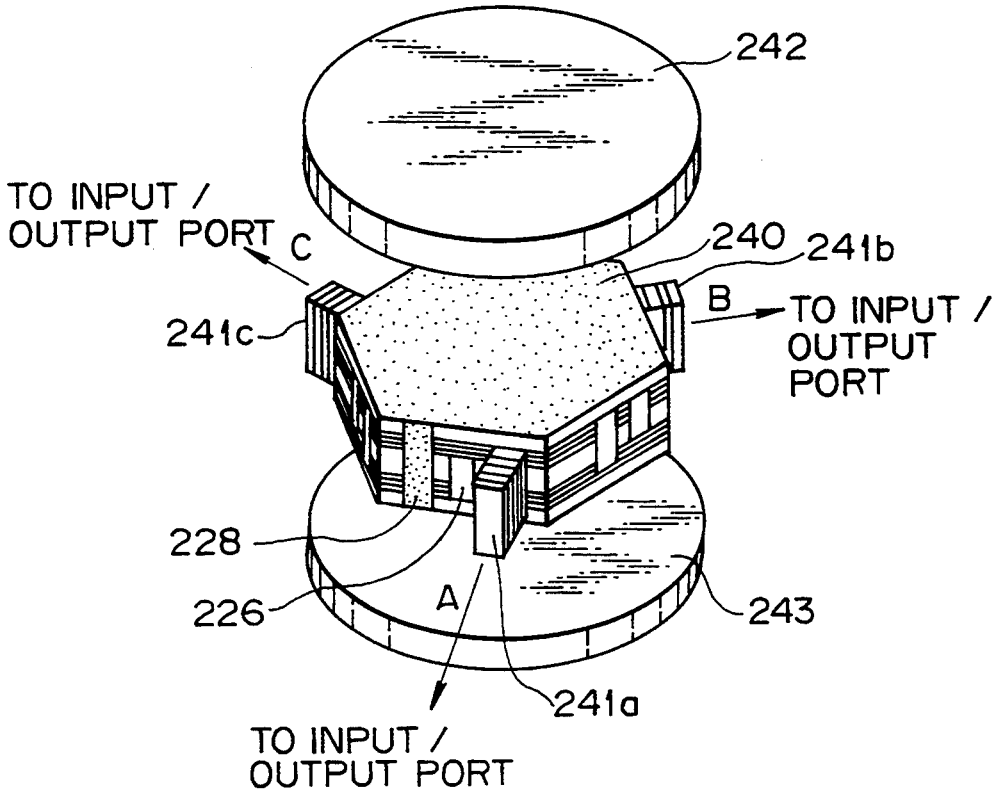
Figure 25A:
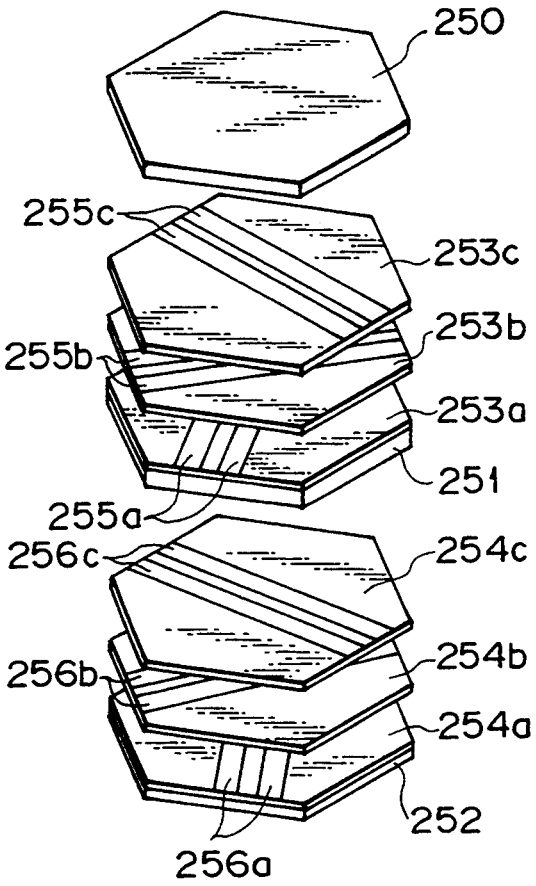
Figure 25B:
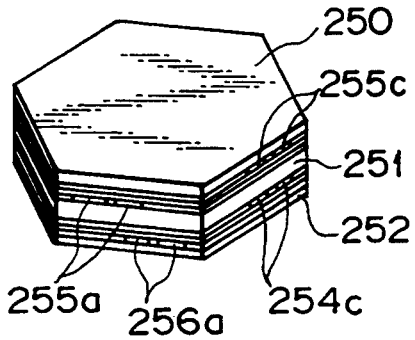
Figure 25C:
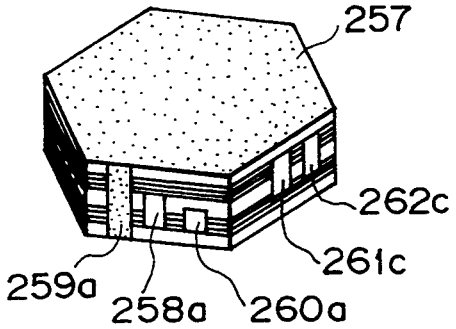
Figure 26:
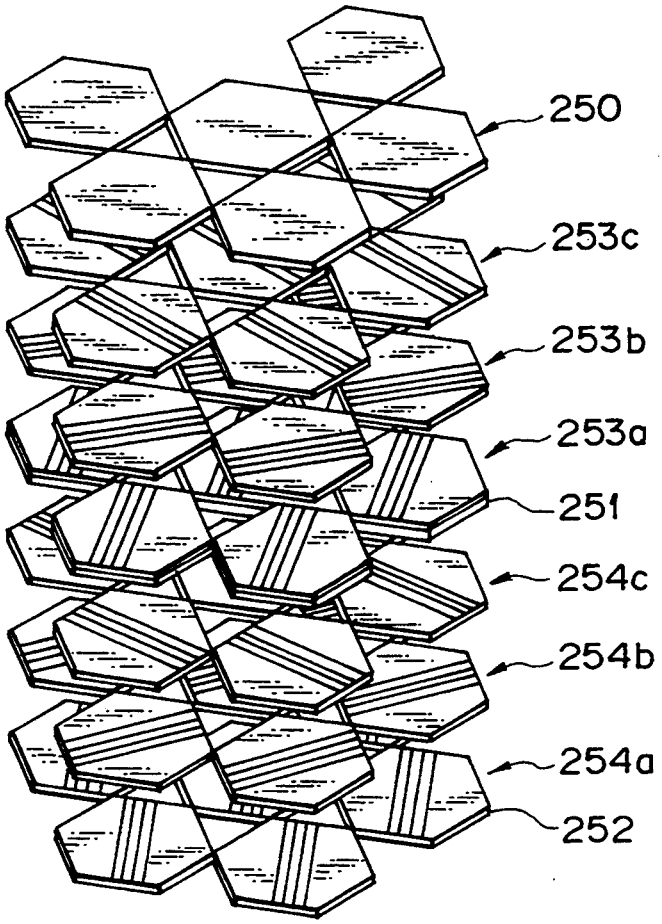
Figure 27:
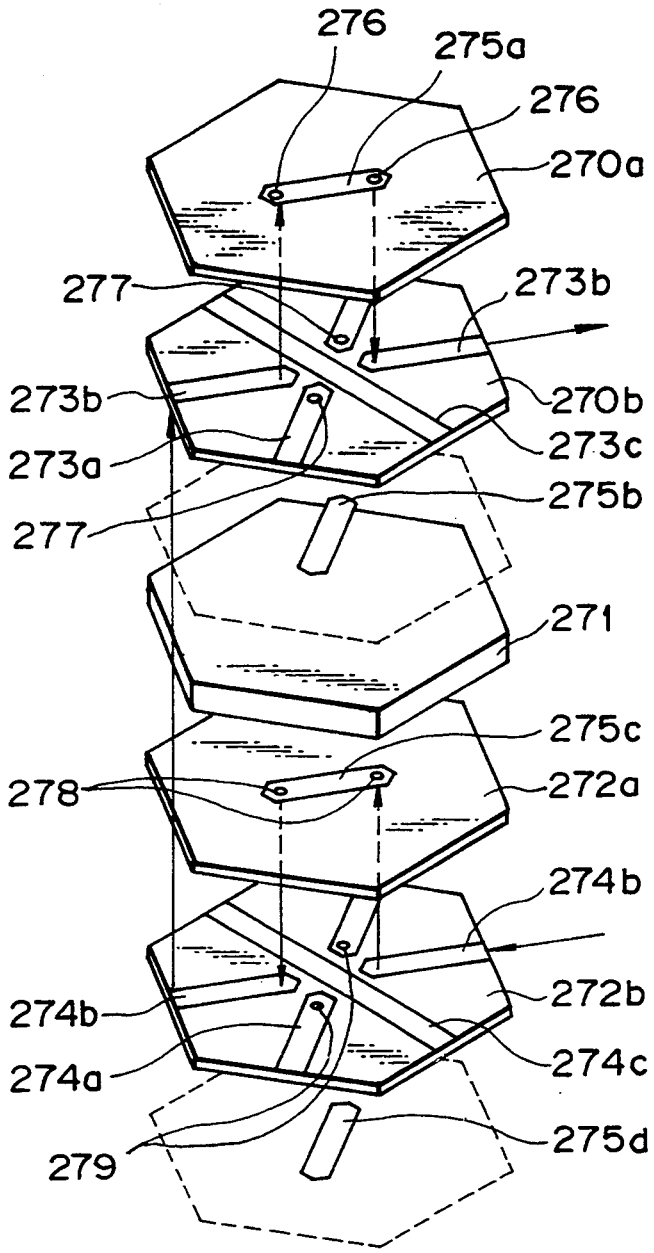
Figure 28:
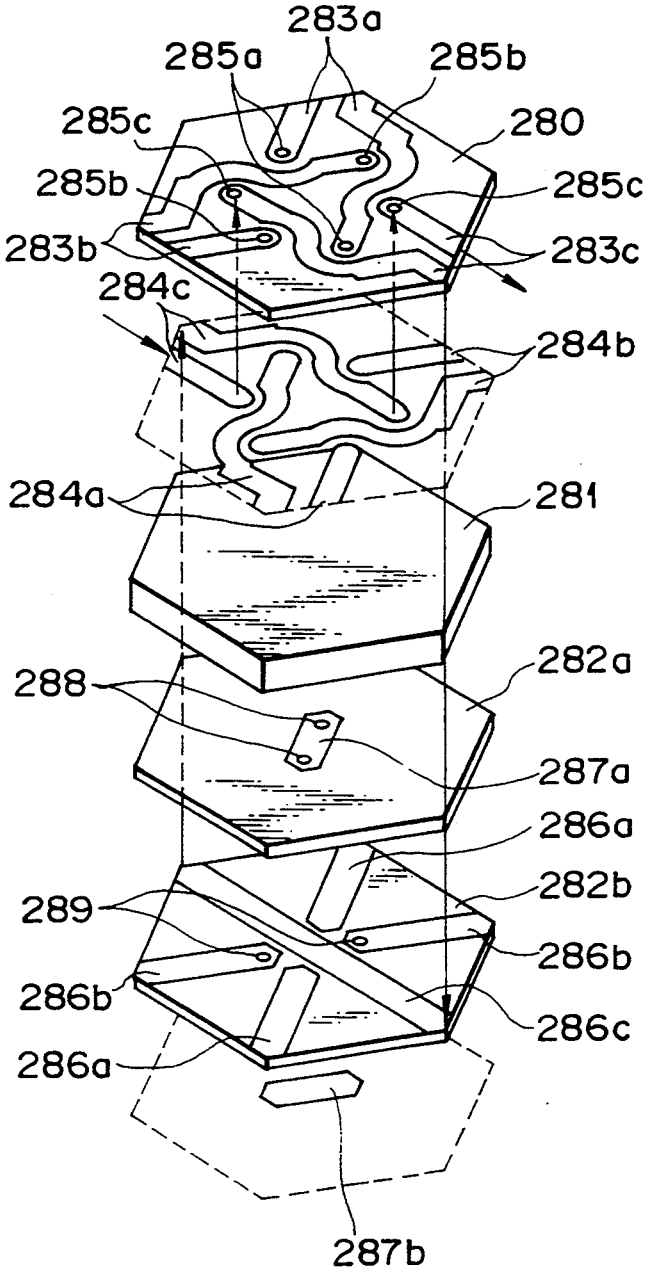
Figure 29:
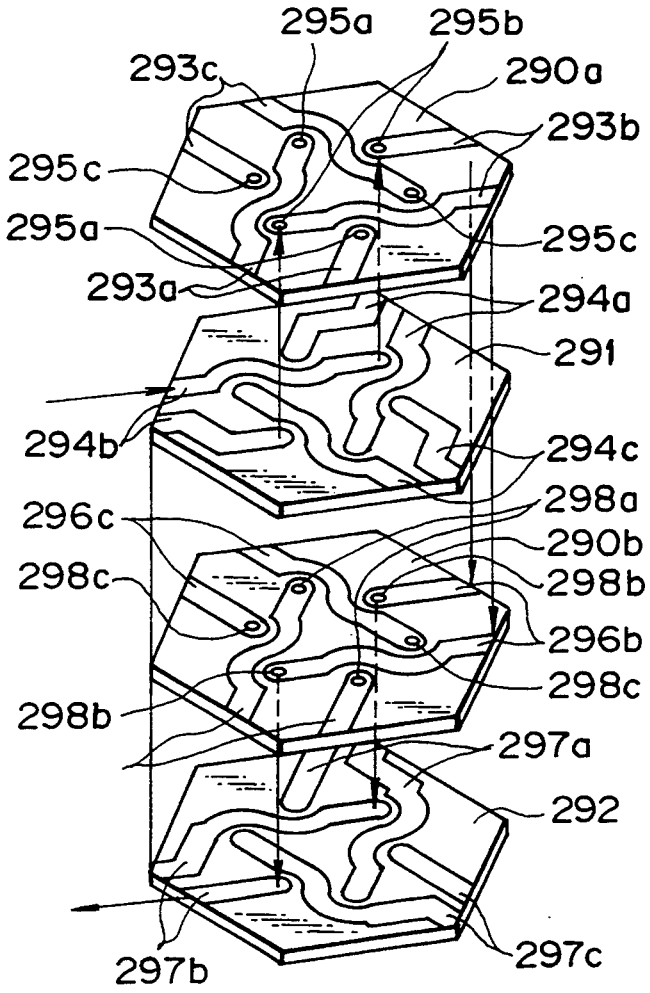
Figure 30:
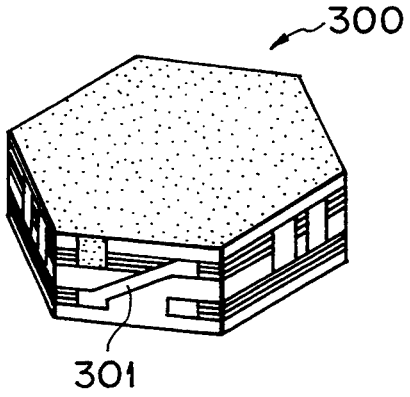
Figure 31A:
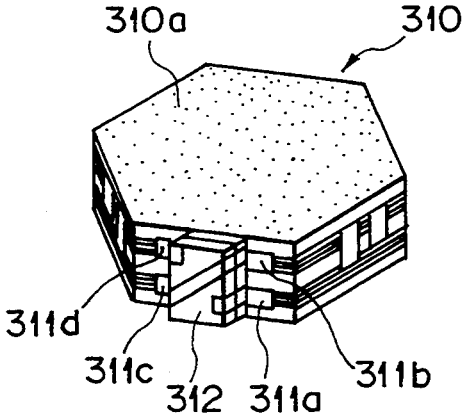
Figure 31B:
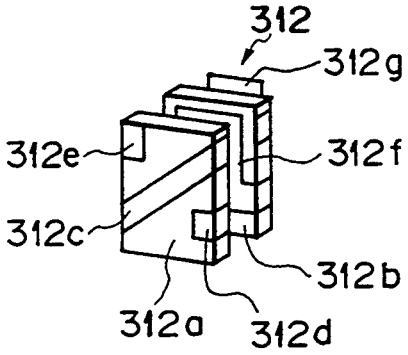
Figure 31C:
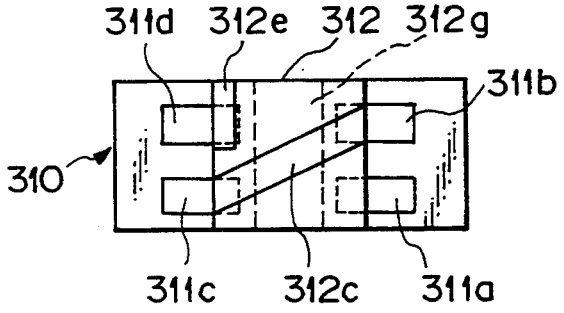
Figure 32:
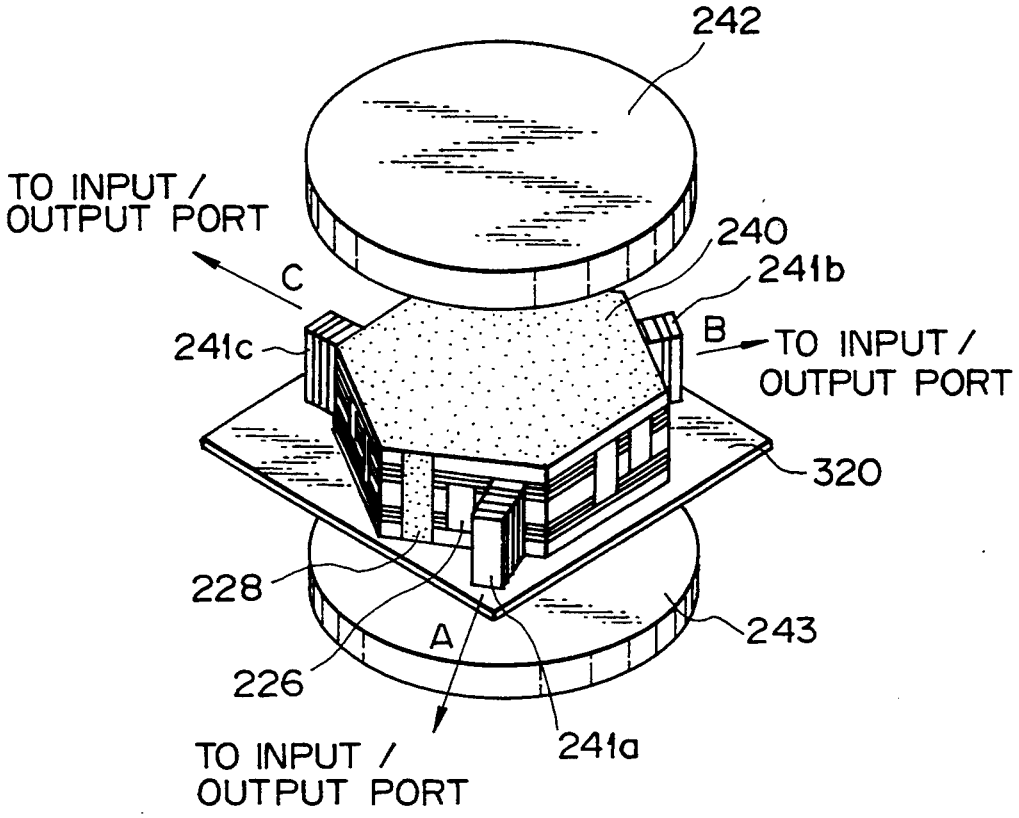

FIGS. *7a*, *7b* and *7c* illustrate a part of manufacturing processes of the circulator element shown in FIG. 4;

FIG. 8 is an exploded oblique view showing an arrangement example of the circulator elements on ferromagnetic material sheets;

FIG. 9 is an oblique view showing an another arrangement example of the circulator elements on a ferromagnetic material sheet;

FIGS. 10*a* and 10*b* are plane arrangement views illustrating a dicing process of the circulator elements on a ferromagnetic material sheet;

FIGS. 11*a*, 11*b* and 11*c* are exploded oblique views and an oblique view illustrating a structure of a housing and a structure of the circulator with the circulator element and excitation permanent magnets assembled in the housing;

FIG. 12 illustrates insertion loss characteristics of the circulator of FIG. 4 and the conventional circulator;

FIG. 13 is an exploded oblique view schematically showing a circulator element as another embodiment of a three-port circulator according to the present invention;

FIG. 14 is an exploded oblique view schematically showing a circulator element as a further embodiment of a three-port circulator according to the present invention;

FIGS. 15*a*, 15*b*, 15*c*, 15*d* and 15*e* are exploded oblique views and oblique views schematically illustrating a circulator element, a three-port circulator and a structure of resonating capacitor to be attached to the circulator as a still further embodiment of the circulator according to the present invention;

FIG. 16 is an exploded oblique view schematically showing a circulator element as another embodiment of a three-port circulator according to the present invention;

FIG. 17 is an exploded oblique view schematically showing a circulator element as a further embodiment of a three-port circulator according to the present invention;

FIG. 18 is an exploded oblique view schematically showing a circulator element as another embodiment of a three-port circulator according to the present invention;

FIG. 19 is an exploded oblique view schematically showing a part of a three-port circulator as another embodiment according to the present invention;

FIG. 20 is an exploded oblique view schematically showing a part of a three-port circulator as a further embodiment according to the present invention;

FIG. 21 is an equivalent circuit diagram of the circulator shown in FIG. 20;

FIG. 22 is a partially cut away oblique view schematically showing a circulator element of a three-port circulator as a still another embodiment according to the present invention;

FIG. 23 is an exploded oblique view showing the circulator element of FIG. 22;

FIG. 24 is an exploded oblique view showing the circulator using the circulator element of FIG. 22;

FIGS. 25*a*, 25*b* and 25*c* illustrate a part of the manufacturing processes of the circulator element shown in FIG. 22;

FIG. 26 is an exploded oblique view showing an arrangement example of the circulator elements on ferromagnetic material sheets;

FIG. 27 is an exploded oblique view schematically showing a circulator element as a further embodiment of a three-port circulator according to the present invention;

FIG. 28 is an exploded oblique view schematically showing a circulator element as a still further embodiment of a three-port circulator according to the present invention;

FIG. 29 is all exploded oblique view schematically showing a circulator element as another embodiment of a three-port circulator according to the present invention;

FIG. 30 is all oblique view schematically showing a circulator element as a further embodiment of a three-port circulator according to the present invention;

FIGS. 31*a*, 31*b* and 31*c* are an oblique view, an exploded oblique view and a side view schematically illustrating a circulator element and a structure of resonating capacitor to be attached to the circulator as a still further embodiment of the circulator according to the present invention; and FIG. 32 is an exploded oblique view schematically showing a circulator element as another embodiment of a three-port circulator according to the present invention.

DESCRIPTION OF THE PREFERRED EMBODIMENTS

Figure 5:
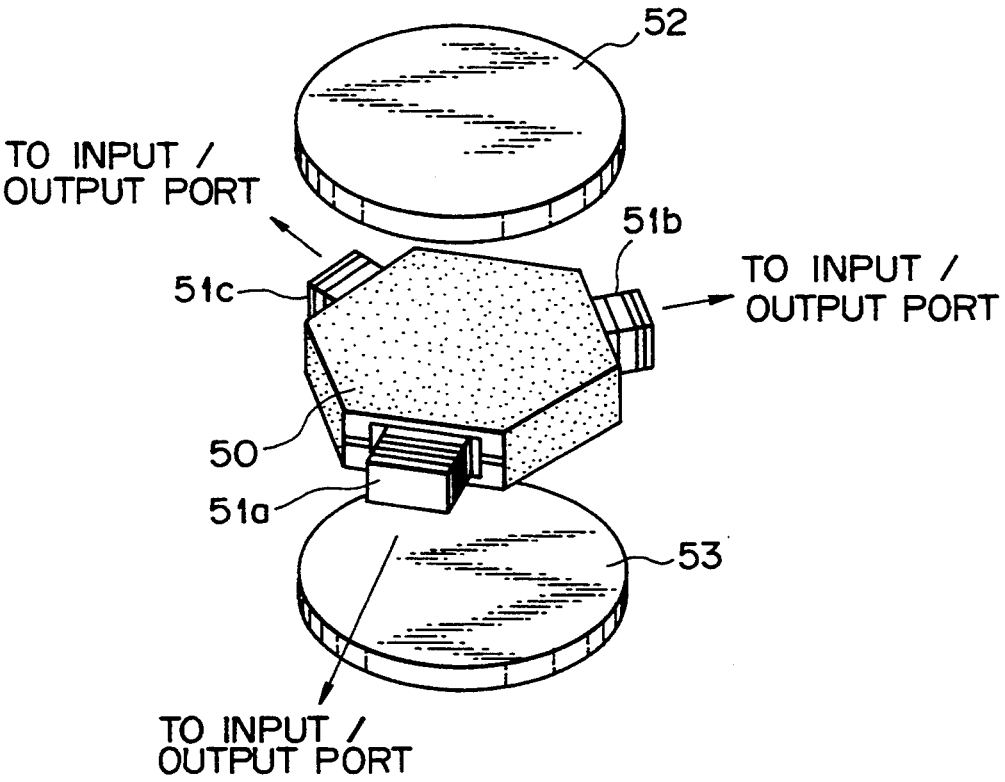
FIG. 5 is an exploded oblique view showing the circulator using the circulator element of FIG. 4.
Figure 6:
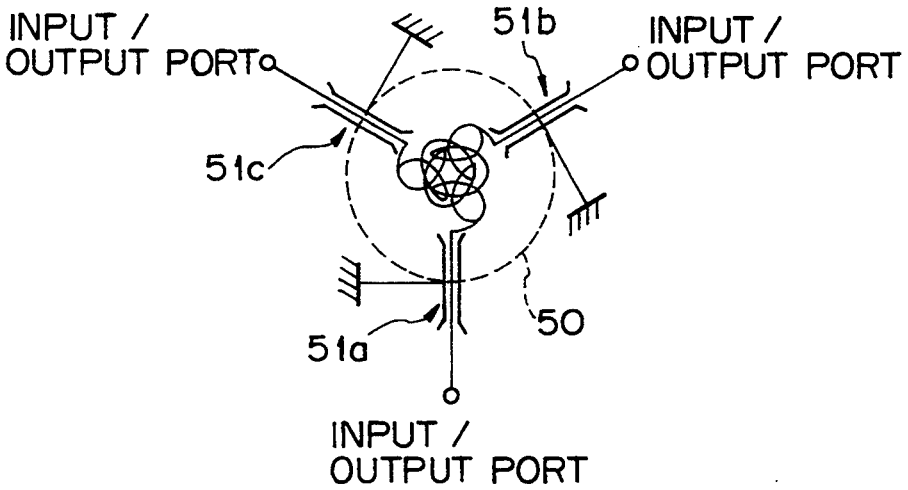
FIG. 6 is an equivalent circuit diagram showing the circulator of FIG. 5.

FIG. 4 schematically shows a circulator element of a three-port circulator as preferred embodiment according to the present invention, FIG. 5 shows the circulator using this circulator element, FIG. 6 shows an equivalent circuit of this circulator, and FIGS. *7a*, *7b* and *7c* illustrate a part of manufacturing process of the circulator element.

As shown in these figures, the circulator of this embodiment is a three-port circulator and its circulator element is formed with a plane shape of a regular hexagon. However, the plane shape of this element may be formed in any hexagonal shape or another polygonal shape so far as a symmetrical rotating magnetic field can be produced. Due to the polygonal plane shape of the circulator element, spaces for attaching discrete circuit elements such as resonating capacitors or termination resisters will remain on side surfaces of the circulator element. Therefore, if such discrete circuit elements are additionally attached to the circulator element, a total size of the circulator can be maintained small.

In FIG. 4, a reference numeral 40 denotes an integral ferromagnetic material body sintered into a single continuous layer. Inner conductors (center conductors) 41 with a predetermined pattern are formed so as to be surrounded by the ferromagnetic material body 40. As shown in FIG. 4, the inner conductors 41 in this embodiment are formed on two laminated ferromagnetic material layers. On each layer (in a plane), the inner conductors are patterned in three pairs of strips extending to symmetrical radiating directions (directions perpendicular to at least one side of the hexagon). The strip coil pattern on both layers, extending in the same directions, are electrically connected by via hole conductors with each other, respectively. In this structure, the ferromagnetic material layers are also utilized as insulating layers. One end of the inner conductors 41 is electrically connected to terminal electrodes 42 formed on every other side surface of the ferromagnetic material body 40, respectively. Grounding conductors (grounding electrodes) 43 are formed on a top surface and a bottom surface and also on the remaining side surfaces of the ferromagnetic material body 40. The other ends of the inner conductors 41 are electrically connected to the grounding conductors 43 on the side surfaces, respectively.

As shown in FIG. 5, the circulator has resonating capacitors 51*a*, 51*b* and 51*c* electrically connected to the three terminal electrodes (42) formed on the side surfaces of the circulator element 50, respectively. These capacitors 51*a*, 51*b* and 51*c* may be high frequency feed through capacitors having a high self-resonance frequency, described in Japanese unexamined patent publication No. 5(1993)-251262 filed by the same applicant (assignee) as this application. This high frequency capacitor has a multi-layer triplate strip line structure constituted by laminating at least two multi-layer units, a grounding conductor and dielectric layer in this order. Each of the multi-layer unit is formed by laminating a grounding conductor, a dielectric layer, an inner conductor and a dielectric layer in this order. By using such a feed through capacitor having a broader operating frequency range, no reduction of Q can be expected. FIG. 6 shows an equivalent circuit of the circulator with these feed through resonating capacitors 51*a*, 51*b* and 51*c*.

On and under the circulator element 50, excitation permanent magnets 52 and 53 for applying a de magnetic field 41 (shown in FIG. 4) to this circulator element 50 are attached, respectively. Assembling of a housing not shown in FIG. 5 and the permanent magnets 52 and 53 with the circulator element 50 will be described in detail later.

Hereinafter, manufacturing process of the circulator according to this embodiment will be described.

Figure 7A:
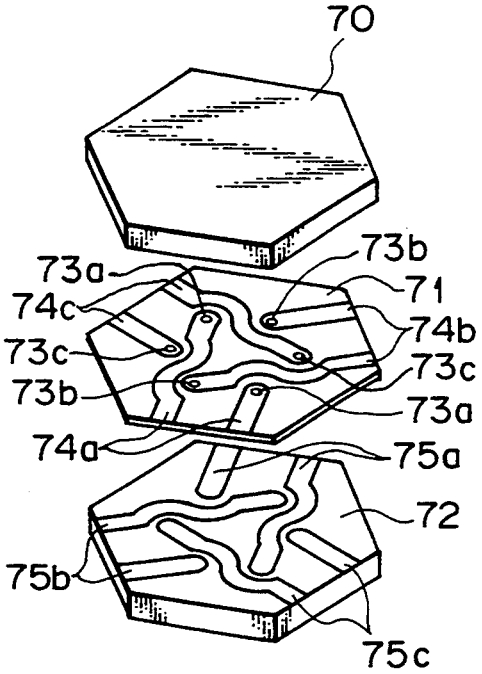

As shown in FIG. 7*a*, an upper ferromagnetic material sheet 70 having a thickness of about 1 mm, an intermediate ferromagnetic material sheet 71 having a thickness of about 160 μm and a lower ferromagnetic material sheet 72 having a thickness of about 1 mm are prepared. The upper and lower ferromagnetic material sheets 70 and 72 are formed by laminating a plurality of sheets with a thickness in general of 100 to 200 μm (preferably 160μ). These ferromagnetic material sheets are made of the same insulating ferromagnetic material. This ferromagnetic material may be yttrium iron garnet (hereinafter called as YIG) and the ferromagnetic material sheets will be made of YIG, a binder and a solvent with the following ratio of components.

YIG powder 61.8 weight %
binder 5.9 weight %
solvent 32.3 weight %

Via holes 73*a*, 73*b* and 73*c* passing through the intermediate sheet 71 are formed at predetermined positions of this sheet 71. At each via hole position, a via hole conductor having a diameter larger than that of the via hole is formed by printing or transferring.

On top surfaces of the intermediate sheet 71 and the lower sheet 72, upper inner conductors 74*a*, 74*b* and 74*c* and lower inner conductors 75*a*, 75*b* and 75*c* are formed. These inner conductors 74*a*, 74*b* and 74*c* (75*a*, 75*b* and 75*c*) have three pairs of strip patterns. Each pair of strip patterns extends in the same radiating direction (a direction perpendicular to at least one side of the hexagon) by stepping aside from the via holes of another strip pattern. These inner conductors may be formed by printing or transferring of silver paste, palladium paste or silver-palladium paste. Thus formed upper sheet 70, intermediate sheet 71 and lower sheet 72 are stacked in this order and then the stacked sheets are hot-pressed. As a result, a trigonally symmetric coil pattern can be formed on the front and rear surfaces of the intermediate sheet 71 so that propagation characteristics between the ports of the three-port circulator will be identical with each other.

Thereafter, the stacked upper sheet 70, intermediate sheet 71 and lower sheet 72 are fired at a temperature such as 1450° C. for example, which is equal to or higher than the melting point of the inner conductor material (about 960° C. when the inner conductor material is silver). This firing process may be carried out one time or more than one time. If a plurality of firings processes are carried out, at least one of the firing must be executed at a temperature equal to or higher than the melting point of the inner conductor material. According to this firing, the ferromagnetic material layers constituting the upper sheet 70, intermediate sheet 71 and lower sheet 73 are integrally formed into a single continuous layer.

Since the sintering completion temperature of the ferromagnetic material YIG is equal to or above the melting point of the inner conductor material (silver or silver-palladium for example), during the firing process, the inner conductor material will be first melted in an airtight state and then the YIG will be sintered. Such an inner conductor melting method for manufacturing an effective microwave circuit element is described in Japanese unexamined patent publications Nos. 5(1993)-183314 and 5(1993)-315757 and U.S. patent application Ser. No. 07/885,639 filed by the same applicant (assignee) as this application. According to the inner conductor melting method, an insulating body and inner conductors are co-fired at a temperature equal to or higher than the melting point of the conductors so that the inner conductors are once converted into a molten state and eventually densified to substantially eliminate grain boundaries attributable to conductor particles used, thereby reducing a propagation line loss. The conductor powder (silver powder) of the paste for the inner conductors may contain equal to or more than 90% by weight, preferably 99% by weight, of pure conductor material (silver). The conductor paste preferably contains 60 to 95% by weight, more preferably 70 to 90% by weight of conductor powder. In order to minimize the development of a network structure after melting of the conductors, equal to or less than 30 mol % of a glass frit having a softening temperature near the melting point of the conductor powder may be added to the conductor powder.

For the via hole conductors, although the same metal paste as that for the inner conductors (silver paste for example) can be used, it is preferred to use another conductor material having a melting point higher than that of the inner conductor material. For example, palladium paste may be used for the via hole conductors when the inner conductors are made of silver. By properly selecting the via hole conductor material and the inner conductor material and also the firing temperature, electrical properties of the inner conductors can be improved. This technique is described in Japanese unexamined patent publications No. 5(1993)-327221 and U.S. patent application Ser. No. 07/885,639 filed by the same applicant (assignee) as this application. According to this technique, a metal having a melting point (about 1555° C. in pure palladium) higher than a sintering completion temperature of the insulating ferromagnetic material (about 1450° C. in YIG) is used for the via hole conductor material and the firing temperature is set higher than the melting point of the inner conductor material and lower than the melting point-of the via hole conductor material (1450° C. for example). Thus, in firing the ferromagnetic material sheets, the via hole conductors, which will not be melted at this temperature, serve as plugs for preventing a loss of the inner conductor material from the sheets causing any degradation of electrical properties due to this loss of the conductor material to be prevented.

By the above-mentioned firing processes, one end of the upper inner conductors 74*a*, 74*b* and 74*c* are electrically connected to one end of the lower inner conductors 75*a*, 75*b* and 75*c* through the via hole conductors in the via holes 73*a*, 73*b* and 73*c*, respectively.

In FIG. 7*a*, each of the upper ferromagnetic material sheet 70, intermediate ferromagnetic material sheet 71 and lower ferromagnetic material sheet 72 is illustrated in a regular hexagonal sheet already separated from that for another circulator element. In fact, it is preferred for mass-production that the stacked and heat-pressed ferromagnetic material sheets each of which has printed inner conductors and via hole conductors for a plurality of the circulator elements is diced into every circulator element before or after the sintering (firing). If it is diced before, sintering, many of the diced circulator elements having a hexagonal shape as shown in FIG. 7*a* are sintered. Whether the dicing should be carried out before or after the sintering will be determined in accordance with the metal used for the inner conductors and with the dicing method. For example, if silver is used for the inner conductors, the dicing will be carried out after the sintering so as to prevent a loss of the molten silver. If palladium is used for the inner conductors, dicing can be executed before the sintering.

FIG. 8 shows an arrangement example of the circulator elements on ferromagnetic material sheets. As shown in this figure, an upper ferromagnetic material sheet 80, an intermediate ferromagnetic material sheet; 81 and a lower ferromagnetic material sheet 82 are prepared and many inner conductors 84 and 85 are printed on top surfaces of the intermediate and lower sheets 81 and 82, respectively. These sheets 80, 81 and 82 are then stacked and sintered and thereafter are diced into each circulator element. The arrangement of the circulator elements on the sheets shown in FIG. 8 has advantages that dicing is easy because of straight line dicing and thus the dicing can be carried out after sintering, but has a disadvantage that waste area of the sheets is not small.

FIG. 9 shows an another arrangement example of the circulator elements on a ferromagnetic material sheet. According to this arrangement, circulator elements of a hexagonal shape are closely arranged so that there is no space between the adjacent circulator elements, and thus the ferromagnetic material sheet will be effectively utilized without waste. In FIG. 9, reference numerals described in circles denote an order of dicing. As will be apparent from the figure, the dicing process may be somewhat complicated if the sheet is diced with this order.

FIGS. 10*a* and 10*b* show plane views of a ferromagnetic material sheet on which the circulator elements are arranged for illustrating a dicing process of the circulator elements. The arrangement of the circulator elements on the ferromagnetic material sheet shown in FIGS. 10*a* and 10*b* is the same as the arrangement example shown In FIG. 9. To manufacture circulator elements according to this example, patterns for the respective circulator elements are printed on the ferromagnetic material sheets so that these circulator elements of a hexagonal shape are closely arranged and there is no space between the adjacent circulator elements at first, and then the sheets are stacked. Snap grooves are formed on the stacked sheet along the boundary of the hexagons. Thereafter, the stacked sheet is punched by one punching operation to separate a plurality of hexagonal circulator element portions a shown in FIG. 10*b* from the stacked sheet. Then, the stacked sheet is punched by another punching operation to separate a plurality of hexagonal circulator element portions b shown in FIG. 10*b* from the stacked sheet. By the above-mentioned two punching operations, a plurality of remaining hexagonal circulator element portions c can be also separated, and thus all the circulator elements are diced from the stacked sheet. The diced circulator elements are then sintered.

Figure 7B:
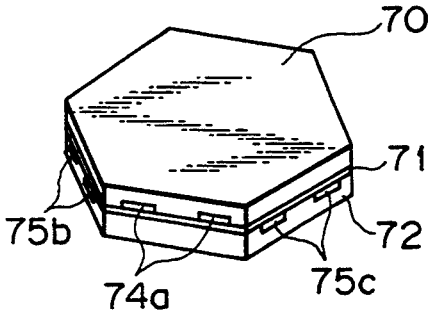
Figure 7C:
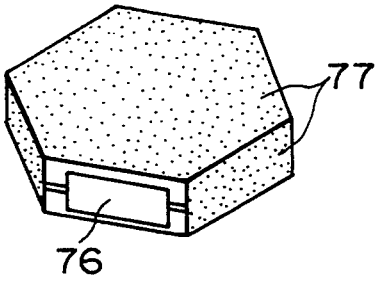

After the dicing and sintering processes, each of the circulator element is barrel polished so that necessary inner conductors appear on the side surface of the circulator element as shown in FIG. 7*b*. Then, corners of the sintered circulator element are chamfered. Thereafter, as shown in FIG. 7*c*, terminal electrodes 76 are formed by baking on every other side surfaces of the circulator element, respectively, and grounding conductors 77 are formed on a top surface and a bottom surface and also on the remaining side surfaces of the circulator element by baking. As a result, the other ends of the upper inner conductors 74*a*, 74*b* and 74*c*, which appear on the side surfaces of the circulator element, are electrically connected to the terminal electrodes (76), respectively. Also, the other ends of the lower inner conductors 75*a*, 75*b* and 75*c*, which appear on the side surfaces of the circulator element, are electrically connected to the grounding conductors (77).

The circulator element thus manufactured has a plane shape in a regular hexagon inscribed in a circle with 4 mm diameter and has a thickness of 1 mm. The resonating capacitors 51*a*, 51*b* and 51*c* are mounted and soldered by a reflow soldering to the terminal electrodes (76) of the circulator element, respectively, as shown in FIG. 5. A circulator is then finished by assembling excitation permanent magnets for applying a dc magnetic field and a metal housing operating also as a magnetic yoke, with the circulator element.

FIGS. 11*a*, 11*b* and 11*c* illustrate a structure of a housing and a structure of the circulator with the circulator element and excitation permanent magnets assembled in the housing. In assembling a circulator, as shown in FIG. 11*a*, the excitation permanent magnets 112 and 113 are stacked respectively on and under the circulator element 110 which has the resonating capacitors 111*a* attached to its side surfaces. Then, the stacked block of the circulator element 110 and the permanent magnets 112 and 113 are sandwiched and supported between support members 114 and 115 made of an insulating material as shown in FIG. 11*b*. At this time, elastic connection leads 117*a* with cream solder are mechanically caught between input/output terminals 116*a* formed in the insulating support members 114 and 115 and the resonating capacitors 111*a* attached to the circulator element 110 or terminal electrodes formed on the side surfaces of the circulator element 110, respectively. The connection lead 117*a* may be constituted by a U-turned elastic thin strip of copper for example. The insulating support member 114 (115) is formed by molding ceramic, glass reinforced epoxy or another plastic material capable of resisting high temperature.

Then, as shown in FIGS. 11*b* and 11*c*, the assembly 118 constituted by the stacked block and the insulating support members 114 and 115 is closely inserted into a metal housing 119 and fixed in the housing 119 by bending projected tongue portions 120. Thus, the metal housing 119 and the permanent magnets 112 and 113 are closely contacted with each other. The metal housing 119 is made of a metal capable of operating as a magnetic yoke and the surface of the housing is plated by nickel or chromium. The metal housing 119 itself has substantially a square drum shape with integrally surrounding four faces and opened on two opposite faces.

The assembly 118 thus fixed in the housing 119 will be passed through a reflow soldering oven and soldered so that the connection leads 117*a* are electrically connected to the input/output terminals 116*a* and to the resonating capacitors 111*a* or the terminal electrodes, respectively. FIG. 11*c* shows the finished circulator 121.

Operating frequency range and loss of the circulator is mainly determined by the performance of its circulator element. A larger difference between the permeability $\mu_+$ and $\mu_-$ and also lower coil resistance and lower magnetic loss tangent will result in a broader operating frequency range and lower loss of the circulator element. The circulator according to this embodiment using the inner conductor melting method can obtain following advantages.

(1) Since the ferromagnetic material layers are sintered into a single continuous layer, the RF magnetic flux will close in the circulator element. Therefore, no demagnetizing field will be produced and thus the difference between the permeability $\mu_+$ and $\mu_-$ will become large. As a result, higher inductance can be obtained causing the circulator to be downsized.

(2) Since the ferromagnetic material layers are sintered into a single continuous layer, the RF magnetic flux will close in the circulator element. Therefore, no demagnetizing field will occur and thus the difference between the permeability $\mu_+$ and $\mu_-$ will become larger resulting in a broader operating frequency range.

(3) The inner conductors are formed by the inner conductor melting method. Therefore, its resistance will be low resulting in lower loss.

(4) Since the structure of the circulator element is proper for mass production, a sharp reduction in the manufacturing cost can be expected.

(5) Since the magnetic yoke constituted by the metal housing is united without separation and has a continuous magnetic path and also the magnetic yoke is closely contacted to the excitation permanent magnets, the excitation magnetic path is continuous without a break. Thus, the magnetic resistance in the magnetic path will become extremely lower resulting in excellent characteristics of the circulator.

FIG. 12 illustrates insertion loss characteristics of the circulator of FIG. 4 and the conventional circulator having the same size as that of the former one. In the figure, the latitudinal axis indicates frequency and the longitudinal axis indicates an insertion loss between non-propagating ports and an insertion loss between propagating ports. It is apparent from this figure that the circulator according to the embodiment of FIG. 4 (the inner conductor melting method is used) has a lower center operating frequency and lower loss than the conventional circulator.

FIG. 13 schematically shows a circulator element of a three-port circulator as another embodiment according to the present invention. In this embodiment, the constitution of inner conductors (center conductors) differ from that in the embodiment of FIG. 4. As shown in FIG. 13, an upper ferromagnetic material sheet 130, a first intermediate ferromagnetic material sheet 131, a second intermediate ferromagnetic material sheet 132 and a lower ferromagnetic material sheet 133 are prepared. These ferromagnetic material sheets are made of the same insulating ferromagnetic material.

On a top surface of the second intermediate sheet 132, inner conductors (coil conductors) 134 having three straight strips are formed. These strips extend to symmetrical radiating directions (directions perpendicular to at least one side of the hexagon). On top surfaces of the first intermediate sheet 131 and the lower sheet 133, inner conductors 135 and 136 having a cross over pattern are formed, respectively. Via holes 137*a* and 137*b* passing through the first and second intermediate sheets 131 and 132, respectively, are formed at predetermined positions of these sheets. At each via hole position, a via hole conductor having a diameter larger than that of the via hole is formed. To form driving lines, the strips of the inner conductors 134 formed on the second intermediate sheet 132 are connected to the cross over inner conductors 135 and 136 by the via hole conductors 137*a* and 137*b*, respectively.

As well as the embodiment of FIG. 4, thus formed upper sheet 130, first intermediate sheet 131, second intermediate sheet 132 and lower sheet 133 are stacked in this order and then sintered into a single continuous layer. A ferromagnetic material and conductor material of this embodiment and also the manufacturing method in this embodiment are the same as those of the embodiment of FIG. 4.

According to this embodiment of FIG. 13, since the inner conductors 134 have three straight strip patterns each of which extends to a different direction and most of the driving lines are made on the same plane, excellent high frequency symmetry of the three ports can be expected. Furthermore, due to the small number of the via holes, not only manufacturing of the circulator becomes easy but also more of the insertion loss can be suppressed.

FIG. 14 schematically shows a circulator element of a three-port circulator as a further embodiment according to the present invention in this embodiment also, the constitution of inner conductors (center conductors) differ from that in the embodiment of FIG. 4. As shown in FIG. 14, an upper ferromagnetic material sheet 140, a first intermediate ferromagnetic material sheet 141, a second intermediate ferromagnetic material sheet 142 and a lower ferromagnetic material sheet 143 are prepared. These ferromagnetic material sheets are made of the same insulating ferromagnetic material.

On top surfaces of the first and second intermediate sheets 141 and 142 and the lower sheet 143, upper layer inner conductors (coil conductors) 144, intermediate layer inner conductors 145 and lower layer inner conductors 146 are formed, respectively. The three-layer inner conductors 144, 145 and 146 have pairs of straight strip patterns extending to symmetrical radiating directions different from each other (directions parallel to at least one side of the hexagon). No via hole is formed in these sheets.

As in the embodiment of FIG. 4, thus formed upper sheet 140, first intermediate sheet 141, second intermediate sheet 142 and lower sheet 143 are stacked in this order and then sintered into a single continuous layer. A ferromagnetic material and conductor material of this embodiment and also the manufacturing method of this embodiment are the same as those of the embodiment of FIG. 4.

According to this embodiment of FIG. 14, since the driving lines are constituted by the inner conductors formed on the three respective layers without via hole, manufacturing of the circulator can be easier and increasing of the insertion loss can be effectively suppressed. However, because of the three-layer structure, input impedances of the ports may differ from each other and thus reduction of the propagation characteristics such as increasing of the insertion loss due to reflections or reduction of the isolation may easily occur. Therefore, in a three-layer structure, the width of the upper layer and lower layer inner conductors 144 and 146 is preferably different from the width of the intermediate layer inner conductors 145 so that the input impedances of the ports are equal to each other.

In FIG. 14, although the inner conductor on each sheet is constituted by a pair of straight strip patterns extending in parallel, this inner conductor can be formed in a single straight strip pattern. In the latter case also, it is preferred that the width of the upper and lower inner conductors differs from that of the intermediate inner conductor to match the impedance.

FIGS. 15*a* to 15*e* illustrate a circulator element, a three-port circulator and a structure of resonating capacitor to be attached to the circulator as a still further embodiment of the circulator according to the present invention. In this embodiment, the constitution of inner conductors (center conductors) is substantially the same as that in the embodiment of FIG. 4 except that strip patterns of inner conductors in this embodiment extend to a direction parallel to at least one side of the hexagon.

Figure 15A:
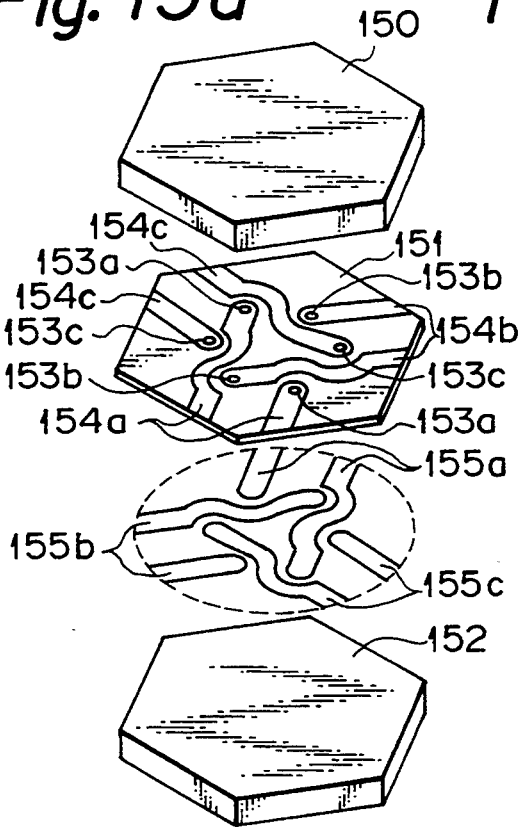

As shown in FIG. 15*a*, on top and bottom surfaces of an intermediate ferromagnetic material sheet 151, upper inner conductors (coil conductors) 154*a*, 154*b* and 154*c* and lower inner conductors 155*a*, 155*b* and 155*c* are formed, respectively. On each surface, the inner conductors are patterned in three pairs of strips extending to the symmetrical radiating directions (directions parallel to at least one side of the hexagon). Via holes 153*a*, 153*b* and 153*c* passing through the intermediate sheet 151 are formed at predetermined positions of this sheet 151.

Figure 15B:
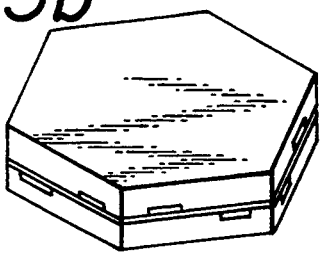

As in the embodiment of FIG. 4, an upper ferromagnetic material sheet 150, the intermediate sheet 151 and a lower ferromagnetic material sheet 152 are stacked in this order and then sintered into a single continuous layer. By this firing process, one end of the upper inner conductors 154*a*, 154*b* and 154*c* is electrically connected to one end of the lower inner conductors 155*a*, 155*b* and 155*c* through the via hole conductors in the via holes 153*a*, 153*b* and 153*c*, respectively. A circulator element after firing is indicated in FIG. 15*b*. A ferromagnetic material and conductor material of this embodiment and also the manufacturing method in this embodiment are the same as those of the embodiment of FIG. 4.

Figure 15C:
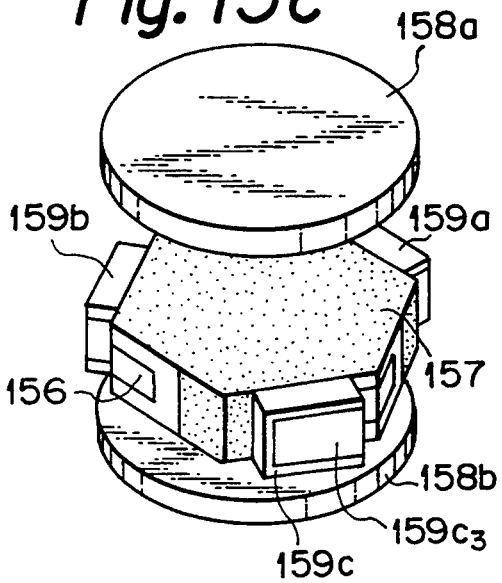

Then, as shown in FIG. 15*c*, terminal electrodes 156 are formed by baking on a part of the side surfaces of the circulator element, respectively. Grounding conductors 157 are formed on the most of a top surface and a bottom surface except for portions near the terminal electrodes 156 and also on a part of the side surfaces of the circulator element by baking. As a result, the other ends of the upper inner conductors 154*a*, 154*b* and 154*c*, which appear on the side surfaces of the circulator element, are electrically connected to the grounding conductors (157). Also, the other ends of the lower inner conductors 155*a*, 155*b* and 155*c*, which appear on the side surfaces of the circulator element, are electrically connected to the terminal electrodes (156), respectively.

Figure 15D:
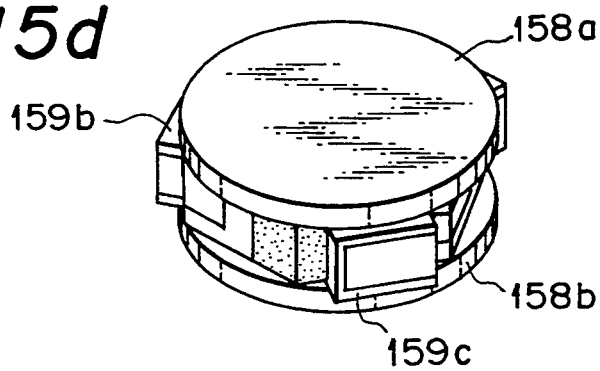

The circulator element thus manufactured has a plane shape in a regular hexagon inscribed in a circle with 4 mm diameter and has a thickness of 1 mm. Resonating capacitors 159*a*, 159*b* and 159*c* are mounted and soldered by a reflow soldering to the terminal electrodes (156) and to the grounding conductors (157) on the side surfaces of the circulator element, respectively, as shown in FIG. 15*c*. A circulator is then finished by assembling exciting permanent magnets 158*a* and 158*b* for applying a dc magnetic field and a metal housing operating also as a magnetic yoke, which is the same as the metal housing already illustrated with reference to FIGS. 11*a* to 11*c*, with the circulator element. FIG. 15*d* shows the circulator element assembly with the excitation permanent magnets 158*a* and 158*b* and with the resonating capacitors 159*a*, 159*b* and 159*c*.

Figure 15E:
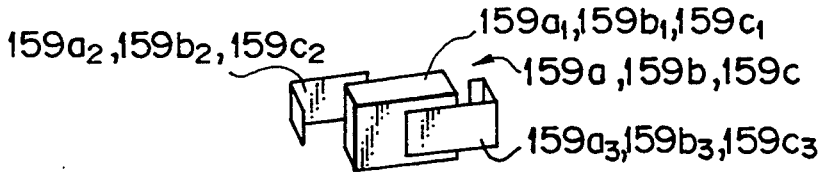

Each of the resonating capacitors 159*a*, 159*b* and 159*c* is a feed through capacitor constituted by a dielectric material block $159a_1$ ($159b_1$, $159c_1$), a grounding electrode $159a_2$ ($159b_2$, $159c_2$) formed on the rear and side surfaces of the dielectric block $159a_1$ and an input/output electrode $159a_3$ ($159b_3$, $159c_3$) formed on the front, rear and side surfaces of the dielectric block $159a_1$, as shown in FIG. 15*e*. The capacitors 159*a*, 159*b* and 159*c* are attached to the side surfaces of the circulator element so that their input/output electrode $159a_3$, $159b_3$ and $159c_3$ appear toward radiating directions of the circulator element as shown in FIG. 15*d*. Accordingly, the connection lead (117*a*) shown in FIG. 11*a* for connecting these input/output electrode $159a_3$, $159b_3$ and $159c_3$ with the input/output terminals formed in the insulating support members (114 and 115) can be very easily mounted.

FIG. 16 schematically shows a circulator element of a three-port circulator as another embodiment according to the present invention. In this embodiment, a dielectric material sheet and capacitor electrodes having the same shape as that of ferromagnetic material sheets are stacked on a circulator element so as to integrally form resonating capacitors with the circulator element.

A circulator element portion in this embodiment is constituted by three of two turned coil conductors substantially surrounded by an insulating ferromagnetic material body. Namely, as shown in FIG. 16, the circulator element portion has an upper ferromagnetic material sheet 160, an intermediate ferromagnetic material sheet 161, a lower ferromagnetic material sheet 162, and ferromagnetic material substrate sheets 163*a*, 163*b*, 163*c*, 164*a*, 164*b* and 164*c* with inner conductors. These ferromagnetic material sheets made of the same insulating ferromagnetic material are stacked and sintered into a single continuous layer.

On top surfaces of the substrate sheets 163*a*, 163*b*, 163*c*, 164*a*, 164*b* and 164*c*, upper inner conductors (parts of coil conductors) 165*a*, 165*b* and 165*c*, and lower inner conductors 166*a*, 166*b* and 166*c* are formed, respectively. Each of the inner conductors has straight strips extending to a predetermined direction (a direction nearly perpendicular to at least one side of the hexagon), the number of the strips corresponding to the number of turns of the coil. Each strip of the upper inner conductors 165*a* and of the lower inner conductors 166*a* will be electrically connected in sequence by coil jumper conductors (not shown) for connecting their ends which will appear from the side surfaces of the circulator element after sintering, so as to form the aforementioned two turned coil conductor. Another two turned coil conductors will be formed by the upper inner conductors 165*b* and the lower inner conductors 166*b*, the upper inner conductors 165*c* and the lower inner conductors 166*c*, and not shown coil jumper conductors. On a top surface of the upper sheet 160 and on a bottom surface of the lower sheet 162, grounding conductors for the circulator element will be formed, respectively.

No via hole is formed in the sheets. A ferromagnetic material and conductor material of this embodiment and also the manufacturing method of the circulator element portion in this embodiment are the same as those of the embodiment of FIG. 4. The circulator element portion may be formed in another structure as shown in FIG. 4, FIG. 13, FIG. 14 or FIG. 15*a*.

A resonating capacitor portion in this embodiment is constituted by the grounding conductor 160*a* for the circulator element, formed on the top surface of the upper sheet 160, a first dielectric maternal sheet 167 laminated thereon with the same regular hexagonal shape as the circulator element portion, a capacitor electrodes 168 formed on a top surface of this dielectric sheet 167, a second dielectric material sheet 169 laminated thereon with the same regular hexagonal shape as the circulator element portion, and a capacitor grounding electrode 169*a* formed on a top surface of this dielectric sheet 169. The capacitor electrodes 168 are connected to one end of the coil conductors by capacitor jumper conductors (not shown) formed on the side surfaces of the circulator element, respectively. A part of the grounding conductor 160*a* for the circulator element is omitted so as to prevent the capacitor jumper conductors from short-circuiting with it. This grounding conductor 160*a* also operates as a capacitor grounding electrode. Thus, between the capacitor electrodes 168 and the capacitor grounding electrode 169*a* and between the capacitor electrodes 168 and the grounding electrode 160*a*, capacitors are formed respectively. However, if the capacitance value of the capacitors are enough for operating, the second dielectric material sheet 169 and the capacitor grounding electrode 169a may be omitted. In this case, the capacitor electrodes 168 may be used as output terminals for the respective ports.

In this embodiment, the circulator element portion and the resonating capacitor portion are fired together after stacking them. However, if it is difficult to co-fire both portions because sintering characteristics of the dielectric material is different from that of the ferromagnetic material, it is preferred that the circulator element portion and the resonating capacitor portion are individually sintered and thereafter they are coupled with each other by soldering. In the latter case, it is possible to design a modified structure wherein the capacitor electrodes 168 are formed on the top surface of the upper sheet 160 instead of the grounding conductor 160*a* and the first dielectric material sheet 167 is eliminated so that the capacitor grounding electrode 169*a* also operates as a grounding conductor for the circulator element. However, this modified structure is undesirable because the dielectric layer is contained in the circulator element layer causing the permeability be reduced.

According to this embodiment of FIG. 16, since the resonating capacitors are integrally formed with the circulator element, there is no need for additionally attaching discrete resonating capacitors. As a result, the manufacturing process will be very simplified and also the circulator can be downsized.

FIG. 17 schematically shows a circulator element of a three-port circulator as a further embodiment according to the present invention. In this embodiment, resonating capacitors are formed integrally in a circulator element by functioning the ferromagnetic material of the circulator element as a dielectric material for the capacitors.

The circulator element portion in this embodiment is constituted by three of two turned coil conductors substantially surrounded by an insulating ferromagnetic material body. Namely, as shown in FIG. 17, the circulator element portion has a top ferromagnetic material sheet 178, an upper ferromagnetic material sheet 170, an intermediate ferromagnetic material sheet 171, a lower ferromagnetic material sheet 172, and ferromagnetic material substrate sheets 173*a*, 173*b*, 173*c*, 174*a*, 174*b* and 174*c* with inner conductors. These ferromagnetic material sheets made of the same insulating ferromagnetic material are stacked and sintered into a single continuous layer.

On top surfaces of the substrate sheets 173*a*, 173*b*, 173*c*, 174*a*, 174*b* and 174*c*, upper inner conductors (parts of coil conductors) 175*a*, 175*b* and 175*c*, and lower inner conductors 176*a*, 176*b* and 176*c* are formed, respectively. Each of the inner conductors has straight strips extending to a predetermined direction (a direction nearly perpendicular to at least one side of the hexagon), the number of the strips corresponding to the number of turns of the coil. Each strip of the upper inner conductors 175*a* and of the lower inner conductors 176*a* will be electrically connected in sequence by coil jumper conductors (not shown) for connecting their ends which will appear from the side surfaces of the circulator element after sintering, so as to form the aforementioned two turned coil conductor. Another two turned coil conductors will be formed by the upper inner conductors 175b and the lower inner conductors 176b, the upper inner conductors 175c and the lower inner conductors 176c, and not shown coil jumper conductors. On a top surface of the top sheet 178 and on a bottom surface of the lower sheet 172, grounding conductors for the circulator element will be formed, respectively.

No via hole is formed in the sheets. A ferromagnetic material and conductor material of this embodiment and also the manufacturing method of the circulator element portion in this embodiment are the same as those of the embodiment of FIG. 4. The circulator element portion may be formed in another structure as shown in FIG. 4, FIG. 13, FIG. 14 or FIG. 15a.

The resonating capacitor portion in this embodiment is constituted by capacitor electrodes 177 formed on a top surface of the upper sheet 170, the top sheet 178 laminated thereon, and the capacitor grounding electrode 179 (also serving as the grounding conductors for the circulator element) formed on the top surface of the top sheet 178. The capacitor electrodes 177 are connected to one end of the coil conductors by capacitor jumper conductors (not shown) formed on the side surfaces of the circulator element, respectively. The top sheet of the ferromagnetic material functions as a part of layer of the circulator element and also serves as a dielectric layer between the capacitor electrode 177 and the capacitor grounding electrode 179. The capacitor electrodes 177 will be formed at positions so that the operation of the circulator will not be subjected to the influence of the electrodes. The circulator according to this embodiment will be used for an application permitting a small capacitance value of the capacitors.

According to this embodiment of FIG. 17, since the resonating capacitors are integrally formed in the circulator element, there is no need for additionally attaching discrete resonating capacitors. As a result, the manufacturing process will be very simplified and also the circulator can be downsized.

FIG. 18 schematically shows a circulator element of a three-port circulator as a still further embodiment according to the present invention. In this embodiment, a circulator element has a rectangular plane shape. As shown in the figure, an upper ferromagnetic material sheet 180, an intermediate sheet 181 and a lower ferromagnetic material sheet 182, with the rectangular plane shape, are prepared. These ferromagnetic material sheets are made of the same insulating ferromagnetic material. On top and bottom surfaces of the intermediate ferromagnetic material sheet 181, upper inner conductors (coil conductors) 184a, 184b and 184c and lower inner conductors 185a, 185b and 185c are formed, respectively. On each surface, the inner conductors are shaped in three pairs of strips extending in radiating directions. Via holes 183a, 183b and 183c passing through the intermediate sheet 181 are formed at predetermined positions of this sheet 181.

As in the embodiment of FIG. 4, the upper ferromagnetic material sheet 180, the intermediate sheet 181 and the lower ferromagnetic material sheet 182 are stacked in this order and then sintered into a single continuous layer. By this firing processes, one end of the upper inner conductors 184a, 184b and 184c electrically connected to one end of the lower inner conductors 185a, 185b and 185c through the via hole conductors in the via holes 183a, 183b and 183c, respectively, to form driving lines. A ferromagnetic material and conductor material of this embodiment and also the manufacturing method in this embodiment except for the plane shape are the same as those of the embodiment of FIG. 4.

According to this embodiment of FIG. 18, since the driving lines do not have a trigonal symmetry, propagation characteristics between its ports will differ from each other, Thus, it may be difficult to operate this constitution as a circulator well. However, this constitution can operate as an excellent isolator because of its diagonally symmetric shape with respect to a center line. If it is used as an isolator, one end of the inner conductors 184a and 185a will be connected to a termination, and one end of the inner conductors 184b and 185b and of the inner conductors 184c and 185c will be utilized as input/output terminals. The other ends of the inner conductors 184a and 185a, of the inner conductors 184b and 185b, and of the inner conductors 184c and 185c are of course connected to the grounding conductor.

FIG. 19 schematically shows a circulator element of a three-port circulator as another embodiment according to the present invention. In this embodiment, when the resonating capacitors 51a, 51b and 51c are soldered to the circulator element 50, these capacitors and circulator element are first mounted on a substrate 190 and then a fellow soldering is carried out. Except for using the substrate 190, structures, functions and advantages of this embodiment are the same as these of the embodiment of FIG. 4.

FIG. 20 schematically shows a circulator element of a three-port circulator as another embodiment according to the present invention, and FIG. 21 is an equivalent circuit diagram of the circulator shown in FIG. 20. In this embodiment, the circulator is floated from ground by inserting a lumped element LC series resonance circuit or a half wave-length resonator so that the operating frequency range of the circulator becomes broader. Broadbanding of a circulator by arranging a plurality of series resonance circuits in symmetry with respect to the center axis of the circulator between its outer conductor and the ground is known by Japanese patent publication No. 52(1977)-32713.

In FIG. 20, a reference numeral 200 denotes a circulator element formed as similar to any of the aforementioned embodiments. Under the circulator element 200, a triplate line resonator 201 with the same plane shape as that of the circulator element 200 is stacked. The triplate line resonator 201 consists of a dielectric material sheet 202 with a high permeability of about "90" which can be co-fired with its inner conductor, a circular shaped capacitor electrode 203 co-axially formed on a top surface of this dielectric sheet 202, a dielectric substrate 204 stacked under the dielectric sheet 202, a spiral line conductor 205 formed on a top surface the dielectric substrate 204 and provided with a capacitor electrode 205a at its one end and at a center position of the dielectric substrate 204, and a grounding conductor (not shown) on a bottom surface of the substrate 204. A capacitor will be formed between the capacitor electrode 203 and the center electrode 205a of the spiral line conductor 205, and an inductor will be formed by the spiral line portion of the spiral line conductor 205. The other end 205b of the spiral line conductor 205 is connected to the grounding conductor under the substrate 204 through a connection line formed on a side surface of the triplate line resonator 201.

The triplate line resonator 201 is made by stacking the dielectric sheet 202 having the capacitor electrode 203 with the dielectric substrate 204 having the spiral line conductor 205, and by co-firing the dielectric material and the inner conductor. The individually formed triplate line resonator 201 is coupled with the circulator element 200 by connecting the capacitor electrode 203 of the resonator 201 to the grounding conductor formed on the bottom surface of the circulator element 200 at an electrical center position of the grounding conductor using a reflow soldering method.

The aforementioned triplate line resonator is made by an LC series resonance circuit. To make the triplate line resonator by a half wave-length resonator, the length of the spiral line conductor is adjusted to a half wave-length and also a via hole and a via hole conductor therein are formed at a center of the dielectric sheet (202) instead of the capacitor electrode (203). One end of the spiral line conductor, which is positioned at the center of the dielectric substrate (204) is connected to the via hole conductor, and the other end of the spiral line conductor is connected to the grounding conductor under the substrate (204) through a connection line formed on a side surface of the triplate line resonator.

The triplate line resonator is made by stacking the dielectric sheet (202) having the via hole and via hole conductor with the dielectric substrate (204) having the spiral line conductor, and by co-firing the dielectric material and the inner conductor. The individually formed triplate line resonator is coupled with the circulator element by connecting the via hole conductor of the resonator to the grounding conductor formed on the bottom surface of the circulator element at an electrical center position of the grounding conductor using a reflow soldering method.

According to this embodiment, since a triplate line resonator is coupled with a co-fired circulator by stacking with each other, the resonator can be easily and precisely arranged in symmetry with respect to the center axis of the circulator. As a result, a downsized and, broaderband circulator can be easily produced.

FIG. 22 schematically shows a circulator element of a three-port circulator as a further embodiment according to the present invention, FIG. 23 shows an exploded view of this circulator element, FIG. 24 shows the circulator using this circulator element, and FIGS. 25*a*, 25*b* and 25*c* illustrate a part of a manufacturing processes of the circulator element.

As shown in these figures, the circulator of this embodiment is a three-port circulator and its circulator element is formed with a plane shape of a regular hexagon. However, the plane shape of this element ray be formed in any hexagonal shape or another polygonal shape as long as a symmetrical rotating magnetic field can be produced. Due to the polygonal plane shape of the circulator element, spaces for attaching discrete circuit elements such as resonating capacitors or termination resisters will remain on side surfaces of the circulator element. Therefore, if the discrete circuit elements are additionally attached to the circulator element, a total size of the circulator can be maintained small.

In FIG. 22, a reference numeral 220 denotes a two-turns coil conductor substantially surrounded by an insulating ferromagnetic material body. The insulating material body is constituted by an upper insulating ferromagnetic material sheet 221, an intermediate insulating ferromagnetic material sheet 222, and a lower insulating ferromagnetic material sheet 223, stacked and integrally sintered into a single continuous layer. The coil conductor, as shown also in FIG. 23, consists of inner conductors 224 and 225 with a predetermined pattern formed on top surfaces of the intermediate ferromagnetic material sheet 224 and the lower ferromagnetic material sheet 225, respectively, and of coil jumper conductors 226 for connecting ends of the inner conductors 224 and 225 which will appear from the side surfaces of the circulator element after sintering, so as to form the aforementioned two turned coil conductor. Each of the inner conductors 224 and 225 has straight strips extending to a predetermined direction (a direction nearly perpendicular to at least one side of the hexagon), the number of the strips corresponding to the number of turns of the coil.

One end of the coil conductor 220 is electrically connected to a terminal electrode formed on a side surface of the circulator element. Grounding conductors (grounding electrodes) 227 are formed on a top surface and a bottom surface of the circulator element, respectively. These grounding conductors 227 and the other end of the coil conductor 224 are electrically connected by a grounding jumper conductor 228 formed on the side surface of the circulator element. In FIGS. 22 and 23, only the coil conductor 220 for a port A is shown. However, in practical, the similar coil conductors are also formed for ports B and C.

As shown in FIG. 24, the circulator has resonating capacitors 241*a*, 241*b* and 241*c* electrically connected to the three terminal electrodes formed on the side surfaces of the circulator element 240, respectively. These capacitors 241*a*, 241*b* and 241*c* are the same as the resonating capacitors in the embodiment of FIG. 4.

On and under the circulator element :240, exciting permanent magnets 242 and 243 for applying a dc magnetic field to this circulator element 240 are attached, respectively. Assembling of a housing not shown in FIG. 24 and the permanent magnets 242 and 243 with the circulator element 240 are the same as the embodiment of FIG. 4.

Hereinafter, the manufacturing process of the circulator according to this embodiment will be described.

As shown in FIG. 25*a*, an upper ferromagnetic material sheet 250 having a thickness of about 0.5 mm, an intermediate ferromagnetic material sheet 251 having a thickness of about 1 mm, a lower ferromagnetic material sheet 252 having a thickness of about 0.5 mm, and ferromagnetic material substrate sheets 253*a*, 253*b*, 253*c*, 254*a*, 254*b* and 254*c* with inner conductors, having a thickness of about 160 μm are prepared. The upper and lower ferromagnetic material sheets 250 and 252 are formed by laminating a plurality of sheets with a thickness in general of 100 to 200 μm (preferably 160μ). These ferromagnetic material sheets are made of the same insulating ferromagnetic material. This ferromagnetic material may be yttrium iron garnet (hereinafter called as YIG) and the ferromagnetic material sheets will be made of YIG, a binder and a solvent with the following ratio of components.

YIG powder 61.8 weight %
binder 5.9 weight %
solvent 32.3 weight %

On top surfaces of the substrate sheets 253*a*, 253*b*, 253*c*, 54*a*, 254*b* and 254*c*, upper inner conductors (coil conductors) 55*a*, 255*b* and 255*c*, and lower inner conductors 256*a*, 256*b* and 56*c* are formed, respectively. These inner conductors have straight strips extending to symmetrical predetermined directions (directions nearly perpendicular to at least one side of the hexagon), the number of the strips corresponding to the number of turns of the coil. These inner conductors may be formed by printing or transferring of silver paste, palladium paste or silver-palladium paste. Thus formed upper sheet 250, substrate sheet 253*c*, substrate sheet 253*b*, substrate sheet 253*a*, intermediate sheet 251, substrate sheet 254*c*, substrate sheet 254*b*, substrate sheet 254*a*, and lower sheet 252 are stacked in this order and then the stacked sheets are hot-pressed. As a result, a trigonally symmetric coil pattern will be formed on the front and rear sides of the intermediate sheet 251 so that propagation characteristics between the ports of the three-port circulator will be identical with each other.

Thereafter, the stacked sheets are fired at a temperature such as 1450° C. for example, which is equal to or higher than the melting point of the inner conductor material (about 960° C. when the inner conductor material is silver). This firing process may be carried out one time or more than one time. If a plurality of firing processes are carried out, at least one of the firing must be executed at a temperature equal to or higher than the melting point of the inner conductor material. According to this firing, the ferromagnetic material layers constituting the above-mentioned sheet are integrally formed into a single continuous layer.

Since the sintering completion temperature of the ferromagnetic material YIG is equal to or above the melting point of the inner conductor material (silver or silver-palladium for example), during the firing process, the inner conductor material will be first melted in an airtight state and then the YIG will be sintered. Thus, as in the embodiment of FIG. 4, a propagation line loss can be reduced.

In FIG. 25*a*, each of the upper ferromagnetic material sheet 250, intermediate ferromagnetic material sheet 251, lower ferromagnetic material sheet 252, and ferromagnetic material substrate sheets 253*a*, 253*b*, 253*c*, 254*a*, 254*b* and 254*c* is illustrated in a regular hexagonal sheet already separated from that for another circulator element. In fact, it is preferred for mass-production that the stacked and heat-pressed ferromagnetic material sheets each of which has printed inner conductors for a plurality of the circulator elements is diced into every circulator element before or after the sintering (firing). If it is diced before sintering, many of the diced circulator elements having a hexagonal shape as shown in FIG. 25*a* are sintered. Whether the dicing should be carried out before or after the sintering will be determined in accordance with the metal used for the inner conductors and with the dicing method. For example, if silver is used for the inner conductors, the dicing will be carried out after the sintering so as to prevent a loss of the molten silver. If palladium is used for the inner conductors, dicing can be executed before the sintering.

FIG. 26 shows an arrangement example of the circulator elements on ferromagnetic material sheets. As shown in this figure, an upper ferromagnetic material sheet 250, ferromagnetic material substrate sheets 253*c*, 253*b* and 253*a*, an intermediate ferromagnetic material sheet 251, ferromagnetic material substrate sheets 254*c*, 254*b* and 254*a*, and a lower ferromagnetic material sheet 252 are prepared and many inner conductors are printed on top surfaces of the substrate sheets, respectively. These sheets are then stacked and sintered and thereafter are diced into each circulator element. The arrangement of the circulator elements on the sheets shown in FIG. 26 has advantages that dicing is easy because of straight line dicing and thus the dicing can be carried out after sintering, but has a disadvantage that the waste area of the sheets is not small. An another arrangement of the circulator elements on a ferromagnetic material sheet as shown in FIG. 9 and another dicing process of the circulator elements as shown in FIGS. 10*a* and 10*b* may be utilized.

After the dicing and sintering processes, each of the circulator element is barrel polished so that necessary inner conductors appear on the side surface of the circulator element as shown in FIG. 25*b*. Then, corners of the sintered circulator element are chamfered. Thereafter, as shown in FIG. 25*c*, coil jumper conductors, grounding jumper conductors and terminal electrodes are formed by baking on side surfaces of the circulator element, and grounding conductors are formed on a top surface and a bottom surface of the circulator element by baking. For example, on the front side surface (the side surface of the port A shown in FIG. 24) of the circulator element, a coil jumper conductor 258*a* for electrically connecting inner conductors 255*a* and 256*a* appear on this side surface with each other, a grounding jumper conductor 259*a* for electrically connecting an inner conductor 255*a* (one end of the coil conductor) appear on this side surface to grounding conductors 257 formed on the top and bottom surfaces of the circulator element, and a terminal electrode 260*a* for electrically connecting to an inner conductor (the other end of the coil conductor) 256*a* appear on this side surface are formed. On a side surface positioned at the right of this side surface (a side surface opposed to the port C shown in FIG. 24), coil jumper conductors 261*c* and 262*c* for electrically connecting inner conductors 254*c* and 255*c* appear on this side surface with each other are formed, respectively. Thus, three coil conductors each of which starts from the terminal electrode, winds by two turns in the ferromagnetic material, and terminates at the grounding conductor are formed.

The circulator element thus manufactured has a plane shape in a regular hexagon inscribed in a circle with 4 mm diameter and has a thickness of 1 mm. The resonating capacitors 241*a*, 241*b* and 241*c* are mounted and soldered by a reflow soldering to the terminal electrodes (260*a*) of the circulator element, respectively, as shown in FIG. 24. A circulator is then finished by assembling excitation permanent magnets for applying a dc magnetic field and a metal housing operating also as a magnetic yoke, with the circulator element. The structure of the housing and assembling of the circulator element and exciting permanent magnets with the housing are the same as described with reference to FIGS. 11*a* to 11*c*.

Operating frequency range and loss of the circulator is mainly determined by the performance of its circulator element. Larger differences between the permeability $\mu_+$ and $\mu_-$ and also lower coil resistance and lower magnetic tangent will result in broader operating frequency range and lower loss of the circulator element. Furthermore, if the permeability $\mu_+$ and $\mu_-$ is large and also the number of turns of the coil is great (long length of the coil conductor), a necessary inductance will be obtained with a compact size. The circulator according to this embodiment using the inner conductor melting method can obtain the following advantages.

(1) Since the ferromagnetic material layers are sintered into a single continuous layer, the RF magnetic flux will close in the circulator element. Therefore, no demagnetizing field will be produced and thus the difference between the permeability $\mu_+$ and $\mu_-$ will become large. As a result, higher inductance can be obtained causing the circulator to be downsized.

(2) Since the ferromagnetic material layers are sintered into a single continuous layer, the RF magnetic flux will close in the circulator element. Therefore, no demagnetizing field will occur and thus the difference between the permeability $\mu_+$ and $\mu_-$ will become larger resulting in a broader operating frequency range.

(3) The coil conductors are formed by the inner conductor melting method. Therefore, its resistance will be low resulting in lower loss.

(4) Since the structure of the circulator element is proper for mass production, a sharp reduction in the manufacturing cost can be expected.

(5) Since each of the driving lines are formed in three layers and thus no via hole is formed, not only can the manufacturing process be simplified to reduce the manufacturing cost but also an insertion loss can be effectively suppressed from increasing.

(6) Since the magnetic yoke constituted by the metal housing is united without separation and has a continuous magnetic path and also the magnetic yoke is closely contacted to the exciting permanent magnets, the exciting magnetic path is continuous without a break. Thus, the magnetic resistance in the magnetic path will become extremely lower resulting in excellent characteristics of the circulator.

FIG. 27 schematically shows a circulator element of a three-port circulator as another embodiment according to the present invention. In this embodiment, each of coil conductors is wound by one turn by means of an upper unit and a lower unit and each of the inner conductors has a straight strip pattern, so as to form a hairpin-patterned coil conductor. The constitution, manufacturing processes, and ferromagnetic material and conductive material in this embodiment are the same as in the embodiment of FIG. 22.

As shown in FIG. 27, a circulator element in this embodiment has ferromagnetic material substrate sheets 270*a* and 270*b*, an intermediate ferromagnetic material sheet 271, and ferromagnetic material substrate sheets 272*a* and 272*b*. These ferromagnetic material sheets made of the same insulating ferromagnetic material are stacked in this order and sintered into a single continuous layer. In fact, upper and lower sheets made of the same insulating ferromagnetic material as the above sheets are respectively stacked on a top surface of the substrate sheet 270*a* and a bottom surface of the substrate sheet 272*b*, and integrally sintered into the single continuous layer.

On top surfaces of the substrate sheet 270*b* in the upper unit and of the substrate sheet 272*b* in the lower unit, inner conductors (parts of coil conductors) 273*a*, 273*b* and 273*c*, and inner conductors (parts of coil conductors) 274*a*, 274*b* and 274*c* are formed, respectively. Each of the inner conductors has a straight strip extending to one of three symmetrical radiating directions (directions perpendicular to at least one side of the hexagon). Furthermore, on bottom surfaces of these substrate sheets 270*b* and 272*b* and also on top surfaces of the substrate sheets 270*a* and 272*a*, inner conductors 275*b*, 275*d*, 275*a* and 275*c* having cross over patterns are formed, respectively. Via holes 276, 277, 278 and 279 passing through the respective substrate sheets 270*a*, 270*b*, 272*a* and 272*b* are formed at predetermined positions of these respective sheets. At each via hole position, a via hole conductor having a diameter larger than that of the via hole is formed. To form coil conductors, each of the strips of the inner conductors 273*a*, 273*b*, 274*a* and 274*b* are connected to the cross over inner conductors 275*b*, 275*d*, 275*a* and 275*c* by these via hole conductors, respectively, and also the upper and lower units are connected with each other by coil jumper conductors (not shown) formed on side surfaces of the circulator element. Namely, one end of the inner conductors 273*a*, 273*b* and 273*c* and one end of the inner conductors 274*a*, 274*b* and 274*c* are connected with each other by the coil jumper conductors.

A path of the one coil conductor is, as shown in FIG. 27, follows. A terminal electrode→one end of the inner conductor 274*b*→the via hole 278→the cross over inner conductor 275*c*→the via hole 278→the other end of the inner conductor 274*b*→the coil jumper conductor→one end of the inner conductor 273*b*→the via hole 276→the cross over inner conductor 275*a*→the via hole 276→the other end of the inner conductor 273*b*→the grounding conductor. On a top surface of the unshown upper sheet and on a bottom surface of the unshown lower sheet, grounding conductors are formed, respectively.

According to this embodiment of FIG. 27, since the inner conductors have three straight strip patterns each of which extends to a different direction and most of the driving lines are made on the same plane, excellent high frequency symmetry of the three ports can be expected. Also, due to a small number of the via holes, not only manufacturing of the circulator becomes easy but also increasing of the insertion loss can be suppressed. It is known from data with respect to a multi-layered inductor that its inductance will increase if one end of its coil is positioned just after the other end of the coil so that the coil is completely closed. Therefore, in this embodiment where each of the coil conductors is wound by one turn in a completely closed state, a high inductance can be obtained with a compact size. Other advantages in this embodiment are the same as that in the embodiment of FIG. 22.

FIG. 28 schematically shows a circulator element of a three-port circulator as another embodiment according to the present invention. In this embodiment, each of coil conductors is wound by one and half turns, an upper unit has inner conductors shaped in three pairs of strip patterns, each of which pair extends to the same radiating direction by stepping aside from the via holes of another strip pattern, and a lower unit has inner conductors shaped in a straight strip pattern. Other constitution, manufacturing processes, and ferromagnetic material and conductive material in this embodiment are the same as these in the embodiment of FIG. 22.

As shown in FIG. 28, a circulator element in this embodiment has a ferromagnetic material substrate sheet 280, an intermediate ferromagnetic material sheet 281, and ferromagnetic material substrate sheets 282*a* and 282*b*. These ferromagnetic material sheets made of the same insulating ferromagnetic material are stacked in this order and sintered into a single continuous layer. In fact, upper and lower sheets made of the same insulating ferromagnetic material as the above sheets are respectively stacked on a top surface of the substrate sheet 280 and a bottom surface of the substrate sheet 282*b*, and integrally sintered into the single continuous layer.

On top and bottom surfaces of the substrate sheet 280 in the upper unit, upper inner conductors (parts of coil conductors) 283*a*, 283*b* and 283*c* and lower inner conductors 284*a*, 284*b* and 284*c* are formed, respectively. On each surface, the inner conductors are patterned in three pairs of strips extending symmetrical radiating directions (directions parallel to at least one side of the hexagon). Via holes 285*a*, 285*b* and 285*c* passing through the substrate sheet 280 are formed at predetermined positions of this sheet 280. At each via hole position, a via hole conductor having a diameter larger than that of the via hole is formed. One end of the upper inner conductors 283*a*, 283*b* and 283*c* is electrically connected to one end of the lower inner conductors 284*a*, 284*b* and 284*c* through the via hole conductors in the via holes 285*a*, 285*b* and 285*c*, respectively.

On a top surface of the substrate sheet 282*b* in the lower unit, inner conductors (parts of coil conductors) 286*a*, 286*b* and 286*c* are formed. Each of the inner conductors has a straight strip extending to one of three symmetrical radiating directions (directions parallel to at least one side of the hexagon). Furthermore, on a bottom surface of the substrate sheet 282*b* and also on a top surface of the substrate sheet 282*a*, inner conductors 287*a* and 287*b* having cross over patterns are formed, respectively. Via holes 288 and 289 passing through the respective substrate sheets 282*a* and 282*b* are formed at predetermined positions of these respective sheets. At each via hole position, a via hole conductor having a diameter larger than that of the via hole is formed. By means of these via hole conductors, each of the strips of the inner conductors 286*a* and 286*b* are connected to the cross over inner conductors 287*a* and 287*b*, respectively.

The upper and lower units are connected with each other by coil jumper conductors (not shown) formed on side surfaces of the circulator element so as to form coil conductors. Namely, one end of the inner conductors 283*a*, 283*b* and 283*c* and one end of the inner conductors 286*a*, 286*b* and 286*c* are connected with each other by the coil jumper conductors, and also the other ends of the inner conductors 286*a*, 286*b* and 286*c* and one end of the inner conductors 284*a*, 284*b* and 284*c* are connected with each other by the coil jumper conductors, respectively.

A path of the one coil conductor is, as shown in FIG. 28, follows. A terminal electrode→one strip of the inner conductor 284*c*→the via hole 285*c*→one strip of the inner conductor 283*c*→the coil jumper conductor→one end of the inner conductor 286*c*→the other end of the inner conductor 286*c*→the coil jumper conductor→the other strip of the inner conductor 284*c*→the via hole 285*c*→the other strip of the inner conductor 283*c*→the grounding conductor. On a top surface of the unshown upper sheet and on a bottom surface of the unshown lower sheet, grounding conductors are formed, respectively.

According to this embodiment of FIG. 28, since each of the coil conductors is wound by one and half turns in a completely closed state, a high inductance can be obtained with a compact size. Other advantages in this embodiment are the same as in the embodiment of FIG. 22.

FIG. 29 schematically shows a circulator element of a three-port circulator as a further embodiment according to the present invention. In this embodiment, each of the coil conductors is wound by two turns, and each of upper and lower units has inner conductors shaped in three pairs of strip patterns, each of which pair extends to the same radiating direction by stepping aside from the via holes of another strip pattern. Other constitution, manufacturing processes, and ferromagnetic material and conductive material in this embodiment are the same as in the embodiment of FIG. 22.

As shown in FIG. 29, a circulator element in this embodiment has a ferromagnetic material substrate sheet 290*a*, an intermediate ferromagnetic material sheet 291, a ferromagnetic material substrate sheet 290*b*, and a lower ferromagnetic material sheet 292. These ferromagnetic material sheets made of the same insulating ferromagnetic material are stacked in this order and sintered into a single continuous layer. In fact, an upper sheet made of the same insulating ferromagnetic material as the above sheets is stacked on a top surface of the substrate sheet 290*a*, and integrally sintered into the single continuous layer.

On top surfaces of the substrate sheet 290*a* and the intermediate sheet 291 in the upper unit, upper inner conductors (parts of coil conductors) 293*a*, 293*b* and 293*c* and lower inner conductors 294*a*, 294*b* and 294*c* are formed, respectively. On each surface, the inner conductors are patterned in three pairs of strips extending to symmetrical radiating directions (directions parallel to at least one side of the hexagon). Via holes 295*a*, 295*b* and 295*c* passing through the substrate sheet 290*a* are formed at predetermined positions of this sheet 290*a*. At each via hole position, a via hole conductor having a diameter larger than that of the via hole is formed. One end of the upper inner conductors 293*a*, 293*b* and 293*c* is electrically connected to one end of the lower inner conductors 294*a*, 294*b* and 294*c* through the via hole conductors in the via holes 295*a*, 295*b* and 295*c*, respectively.

Also on top surfaces of the substrate sheet 290*b* and the lower sheet 292 in the lower unit, upper inner conductors (parts of coil conductors) 296*a*, 296*b* and 296*c* and lower inner conductors 297*a*, 297*b* and 297*c* are formed, respectively. On each surface, the inner conductors are shaped in three pairs of strip patterns, each of which pair extends to the same radiating direction (a direction parallel to at least one side of the hexagon). Via holes 298*a*, 298*b* and 298*c* passing through the substrate sheet 290*b* are formed at predetermined positions of this sheet 290*b*. At each via hole position, a via hole conductor having a diameter larger than that of the via hole is formed. One end of the upper inner conductors 296*a*, 296*b* and 296*c* is electrically connected to one end of the lower inner conductors 297*a*, 297*b* and 297*c* through the via hole conductors in the via holes 298*a*, 298*b* and 298*c*, respectively.

The upper and lower units are connected with each other by coil jumper conductors (not shown) formed on side surfaces of the circulator element so as to form coil conductors. Namely, one end the inner conductors 293*a*, 293*b* and 293*c* and one end of the inner conductors 296*a*, 296*b* and 296*c* are connected with each other by the coil jumper conductors, and one end of one strips of the inner conductors 297*a*, 297*b* and 297*c* and one end of one strips of the inner conductors 294*a*, 294*b* and 294*c* are connected with each other by the coil jumper conductors, respectively.

A path of the one coil conductor is, as shown in FIG. 29, follows. A terminal electrode→one strip of the inner conductor 294*b*→the via hole 295*b*→one strip of the inner conductor 293*b*→the coil jumper conductor→one strip of the inner conductor 296*b*→the via hole 298*b*→one strip of the inner conductor 297*b*→the coil jumper conductor→the other strip of the inner conductor 294*b*→the via hole 295*b*→the other strip of the inner conductor 293*b*→the coil jumper conductor→the other strip of the inner conductor 296*b*→the via hole 298*b*→the other strip of the inner conductor 297*b*→the grounding conductor. On a top surface of the unshown upper sheet and on a bottom surface of the lower sheet 292, grounding conductors are formed, respectively.

According to this embodiment of FIG. 29, since each of the coil conductors is wound by two turns in a completely closed state, a high inductance can be obtained with a compact size. Other advantages in this embodiment are the same as in the embodiment of FIG. 22.

FIG. 30 schematically shows a circulator element of a three-port circulator as another embodiment according to the present invention. In this embodiment, each coil jumper conductors 301 formed on respective side surfaces of the circulator element 300 by printing has a slant strip pattern. Except for using the slant coil jumper conductors 301, structures, functions and advantages of this embodiment are the same as the embodiment of FIG. 22.

FIGS. 31*a* to 31*b* illustrate a circulator element and a structure of resonating capacitor to be attached to the circulator element as another embodiment of the circulator according to the present invention. In this embodiment, on side surfaces of the circulator element 310, only connection terminals 311*a*, 311*b*, 311*c* and 311*d* are formed by printing, and terminal electrodes for inputting and outputting signals and jumper conductors are formed in discrete connection terminal substrates 312 with resonating capacitors, which substrates are to be additionally attached to the side surfaces of the circulator element.

As shown in FIG. 31*b*, the connection terminal substrate 312 is constituted by a multi-layer dielectric substrate having a first dielectric layer 312*a* and a second dielectric layer 312*b*. On front and side surfaces of the first dielectric layer 312*a*, a coil jumper conductor 312*c* having an oblique strip pattern, an input/output terminal electrode 312*d* and a grounding conductor 312*e* are formed by printing. On a front surface of the second dielectric layer 312*b*, a capacitor electrode 312*f* is formed by printing and a capacitor grounding electrode 312*g* is formed by printing on its rear surface. A resonating capacitor will be formed between the capacitor electrode 312*f* and the capacitor grounding electrode 312*g*.

In a state that this connection substrate 312 is attached to the side surface of the circulator element 310, as will be apparent from FIG. 31*c*, the coil jumper conductor 312*c* connects the terminals 311*b* and 311*c* of the circulator element 310 with each other. The input/output terminal electrode conducted with the capacitor electrode 312*f* is connected to the terminal 311*a* of the circulator element 310. The grounding conductor 312*e* is connected to the terminal 311*d* and also to a grounding conductor 310*a* formed on a top surface of the circulator element 310. The capacitor grounding electrode 312*g* is also connected to the grounding conductor 310*a*.

The structure in the circulator element 310 of this embodiment is the same as in embodiment of FIG. 22. According to this embodiment of FIGS. 31*a* to 31*c*, since the discrete connection terminal substrate 312, which includes a resonating capacitor and is to be additionally attached to the side surface of the circulator element, has a terminal electrode for inputting and outputting signals and a jumper conductor, all the wiring process can be completed only by carrying out the same process as the attaching process of a resonating capacitor to the circulator element, without printing jumper conductors and grounding conductors on the side surfaces of the circulator element. Thus, the manufacturing process will become easier causing the manufacturing cost to be reduced.

FIG. 32 schematically shows a circulator element of a three-port circulator as another embodiment according to the present invention. In this embodiment, when the resonating capacitors 241*a*, 241*b* and 241*c* are soldered to the circulator element 240, these capacitors and circulator element are first mounted on a substrate 320 and then a fellow soldering is carried out. Except for using the substrate 320, structures, functions and advantages of this embodiment are the same as the embodiment of FIG. 22.

As described with reference to FIG. 20 and 21, the circulator element in the aforementioned embodiments of FIGS. 22, 27, 28, 29, 30, 31*a* to 31*c* and 32 can be combined with a lumped element LC series resonance circuit or a half wave-length resonator so that the operating frequency range of the circulator becomes broader.

Although, the inner conductors are formed by printing silver paste, palladium paste or silver-palladium paste in the aforementioned embodiments, these inner conductor can be formed by patterning silver foil. The inner pattern may be made of gold, palladium, silver-palladium or their alloy in condition that its resistance loss is not so great and no solid solution will occur with the used ferromagnetic material.

For the ferromagnetic material, any insulating ferromagnetic material other than YIG may be used in condition that no solid solution will occur with the inner conductor material.

A circulator according to the present invention can be constituted by using an inner conductor material having a melting point higher than a sintering completion temperature of the insulating ferromagnetic material so as to sinter the ferromagnetic material without melting the inner conductor.

The number of turns of the coil conductors may be freely determined other than the two turns. The larger the number of turns, the greater its inductance.

The above-mentioned embodiments are described with respect to a three-port circulator. However, it will be apparent that the present invention can be applied to a circulator having ports more than three. Also the present invention can be applied to a distributed element circulator having a circulator element integral with a capacitor circuit and having an impedance transformer for broadening the operating frequency band combined in its terminal circuits, other than the lumped element circulator. Furthermore, it is apparent that a non-reciprocal circuit element such as an isolator can be easily formed from any of the circulators according to the present invention.

Many widely different embodiments of the present invention may be constructed without departing from the spirit and scope of the present invention. It should be understood that the present invention is not limited to the specific embodiments described in the specification, except as defined in the appended claims.

What is claimed is:

1. A circulator provided with a circulator element, said circulator element comprising:

inner conductors made of a conductive material; and an insulating ferromagnetic material body closely surrounding said inner conductors, said insulating ferromagnetic material body being constituted by a fired single continuous body having at least one side surface, said inner conductors being constituted by three conductors arranged in a trigonally symmetric shape and insulated from each other, each of said inner conductors extending to the at least one side surface and being grounded at one end.

2. A circulator as claimed in claim 1, wherein said insulating ferromagnetic material body is constituted by a ferromagnetic material having a sintering completion temperature higher than a melting point of the conductive material of said inner conductors.

3. A circulator as claimed in claim 1, wherein said inner conductors are constituted by a conductive material having a melting point higher than a sintering completion temperature of the ferromagnetic material of said insulating ferromagnetic material body.

4. A circulator as claimed in claim 1, wherein said circulator element has a polygonal plane shape.

5. A circulator as claimed in claim 5, wherein said circulator element has a hexagonal plane shape.

6. A circulator as claimed in claim 1, wherein said inner conductors have a pattern with a plurality of strips extending, in a plane, to a plurality of symmetrical radiating directions, respectively.

7. A circulator as claimed in claim 6, wherein said strips include straight strips.

8. A circulator as claimed in claim 1, wherein said inner conductors have a pattern with at least one straight strip extending, in a plane, to a predetermined direction.

9. A circulator as claimed in claim 1, wherein said circulator element includes coil conductors of at least one turn, said inner conductors constituting a part of said coil conductors.

10. A circulator as claimed in claim 9, wherein said coil conductors include the inner conductors formed in said ferromagnetic material layer, and jumper conductors for connecting ends of said inner conductors to each other.

11. A circulator as claimed in claim 9, wherein said insulating ferromagnetic material body is constituted by a ferromagnetic material having a sintering completion temperature higher than a melting point of the conductive material of said inner conductors.

12. A circulator as claimed in claim 9, wherein said inner conductors are constituted by a conductive material having a melting point higher than a sintering completion temperature of the ferromagnetic material of said insulating ferromagnetic material body.

13. A circulator as claimed in claim 9, wherein said ferromagnetic material layer has a top surface and a bottom surface, and wherein said circulator element includes grounding conductors formed on the top surface and the bottom surface, respectively.

14. A circulator comprising:

a circulator element including inner conductors made of a conductive material, and an insulating ferromagnetic material body closely surrounding said inner conductors, said insulating ferromagnetic material body being constituted by a fired single continuous body, said inner conductors being constituted by three conductors arranged in a trigonally symmetric shape and insulated from each other, each of said inner conductors extending to the at least one side surface and being ground at one end;

three terminal electrodes formed on the at least one side surface and electrically connected to one end of said inner conductors;

a plurality of circuit elements electrically connected to the terminal electrodes; and excitation permanent magnets for applying a dc magnetic field to said circulator element.

15. A circulator as claimed in claim 14, wherein said circuit elements are a plurality of capacitors electrically connected to said respective terminal electrodes, for resonating with an applied frequency.

16. A circulator as claimed in claim 14, wherein said circuit elements are discrete circuit elements additionally attached and electrically connected to said respective terminal electrodes.

17. A circulator as claimed in claim 14, wherein said circuit elements are internal circuit elements integrally formed with said circulator element.

18. A circulator as claimed in claim 14, wherein said circulator further includes a metal housing closely fixed to said excitation permanent magnets, said metal housing having a continuous magnetic path.

19. A circulator as claimed in claim 14, wherein said circulator element has a polygonal plane shape.

20. A circulator as claimed in claim 19, wherein said circulator element has a hexagonal plane shape.

21. A circulator as claimed in claim 14, wherein said inner conductors have a pattern with a plurality of strips extending, in a plane, to a plurality of symmetrical radiating directions, respectively.

22. A circulator as claimed in claim 21, wherein said strips include straight strips.

23. A circulator as claimed in claim 14, wherein said inner conductors have a pattern with at least one straight strip extending, in a plane, to a predetermined direction.

24. A circulator comprising:

a circulator element including inner conductors made of a conductive material, and an insulating ferromagnetic material body closely surrounding said inner conductors, said insulating ferromagnetic material body being constituted by a fired single continuous body having at least one side surface, said inner conductors being constituted by three conductors arranged in a trigonally symmetric shape and insulated from each other, each of said inner conductors extending to the at least one side surface and being grounded at one end, said circular element further including coil conductors of at least one turn, said inner conductors constituting a part of said coil conductors;

three terminal electrodes formed on the at least one side surface and electrically connected to one end of said inner conductors;

a plurality of circuit elements electrically connected to the terminal electrodes; and excitation permanent magnets for applying a dc magnetic field to said circulator element.

25. A circulator as claimed in claim 24, wherein said circuit elements are a plurality of capacitor electrically connected to said respective terminal electrodes, for resonating with an applied frequency.

26. A circulator as claimed in claim 24, wherein said circuit elements are discrete circuit elements additionally attached and electrically connected to said respective terminal electrodes.

27. A circulator as claimed in claim 24, wherein said circuit elements are internal circuit elements integrally formed with said circulator element.

28. A circulator as claimed in claim 24, wherein said circulator further includes a metal housing closely fixed to said excitation permanent magnets, said metal housing having a continuous magnetic path.

29. A circulator as claimed in claim 24, wherein said circulator element has a polygonal plane shape.

30. A circulator as claimed in claim 29, wherein said circulator element has a hexagonal plane shape.

31. A circulator as claimed in claim 24, wherein said inner conductors have a pattern with a plurality of strips extending, in a plane, to a plurality of symmetrical radiating directions, respectively.

32. A circulator as claimed in claim 31, wherein said strips include straight strips.

33. A circulator as claimed in claim 24, wherein said inner conductors have a pattern with at least one straight strip extending, in a plane, to a predetermined direction.

34. A process of manufacturing a circulator with a circulator element comprising the steps of:

forming inner conductors made of a conductive material on at least one ferromagnetic material layer;

laminating a plurality of ferromagnetic material layers including said ferromagnetic material layer with the inner conductors so that at least one ferromagnetic material layer covers said inner conductors; and firing the laminated ferromagnetic material layers to form an insulating ferromagnetic material body in a single continuous body having at least one side surface, said inner conductors being constituted by three conductors arranged in a trigonally symmetric shape and insulated from each other, each of said inner conductors extending to the at least one side surface and being grounded at one end.

35. A process as claimed in claim 34, wherein said ferromagnetic material layers are constituted by a ferromagnetic material having a sintering completion temperature higher than a melting point of the conductive material of said inner conductors, and wherein said firing step includes a step of firing the laminated ferromagnetic material layers at a temperature higher than the sintering completion temperature so that said inner conductors are once converted in a molten state.

36. A process as claimed in claim 34, wherein said inner conductors are constituted by a conductive material having a melting point higher than a sintering completion temperature of the ferromagnetic material of said ferromagnetic material layers, and wherein said firing step includes a step of firing the laminated ferromagnetic material layers at a temperature between the melting point and the sintering completion temperature.

37. A process as claimed in claim 34, wherein said laminating step includes a step of laminating an upper ferromagnetic material layer, at least one intermediate ferromagnetic material layer and a lower ferromagnetic material layer in this order, and wherein said forming step includes a step of forming inner conductors on top surfaces of said intermediate ferromagnetic material layer and said lower ferromagnetic material layer.

38. A process as claimed in claim 37, wherein said process further comprises a step of forming, on side surfaces of said ferromagnetic material body, jumper conductors for connecting ends of said inner conductors to each other so that said inner conductors and said jumper conductors forms coil conductors wound at least one turn around said at least one intermediate ferromagnetic material sheet.

39. A process as claimed in claim 34, wherein said process further comprises a step of forming grounding conductors on a top surface of said upper ferromagnetic material layer and a bottom surface of said lower ferromagnetic material layer, respectively, and a step of forming conductors connecting the two groundings with each other provided on a side surface of the ferromagnetic material layer.

40. A process as claimed in claim 34, wherein said process further comprises a step of forming three terminal electrodes on the at least one side surface so as to be electrically connected to one end of said inner conductors, a step of attaching three resonating capacitors on the side surface, a step of electrically connecting said capacitors to the respective electrodes, a step of soldering a grounding substrate to said circulator element, and a step of attaching excitation permanent magnets for applying a dc magnetic field to said circulator element.

* * * * *